US005183406A

United States Patent [19]

Glen

[11] Patent Number: 5,183,406

[45] Date of Patent: * Feb. 2, 1993

[54] BASEBOARD WITH MOVABLE ELECTRICAL OUTLET

[76] Inventor: Bryan D. Glen, 1846 West 14th Avenue, Vancouver, British Columbia, Canada, V6J 2J9

[ * ] Notice: The portion of the term of this patent subsequent to Oct. 1, 2008 has been disclaimed.

[21] Appl. No.: 752,877

[22] Filed: Aug. 30, 1991

Related U.S. Application Data

[63] Continuation-in-part of Ser. No. 499,703, Mar. 27, 1990, Pat. No. 5,052,937.

[51] Int. Cl.[5] ..... H01R 25/14

[52] U.S. Cl. ..... 439/120; 439/211

[58] Field of Search ..... 439/110-122, 439/207, 209-211, 213, 214, 216, 332-334, 359, 361

[56] References Cited

U.S. PATENT DOCUMENTS 5,055,067 10/1991 Field ..... 439/540

FOREIGN PATENT DOCUMENTS 8701524 3/1987 World Int. Prop. O. ..... 439/120

*Primary Examiner*—Gary F. Paumen

*Attorney, Agent, or Firm*—Koppel & Jacobs

[57] ABSTRACT

Existing electrical outlet tracks require that the outlet be slid from one location to another along the track. The present invention provides a readily movable electrical receptacle which also discourages contact with the conductors. The receptacles of the present invention can be readily installed at any location along a baseboard conductor without sliding of the receptacle. This is accomplished using a T-shaped element which is inserted through the lengthwise groove of the continuous track and rotated into place. Screw-mounted bars are used to tighten the receptacle into place at the chosen location. Multiple raceways on a single baseboard, accommodating different types of receptacles, are disclosed.

11 Claims, 32 Drawing Sheets

BASEBOARD WITH MOVABLE ELECTRICAL OUTLET

CROSS-REFERENCE TO RELATED APPLICATIONS

This application is a continuation-in-part of application Ser. No. 07/499,703 filed Mar. 27, 1990 now U.S. Pat. No. 5,052,937 issued Oct. 1, 1991.

BACKGROUND OF THE INVENTION

The invention relates to the field of continuous electrical distribution systems whereby an electrical outlet can be positioned at any one of a number of locations along a wall.

In conventional residential and commercial construction, outlets for electricity and telephones lines are installed in the walls of a room at fixed, spaced locations around the room. When changes are made in the location of the apparatus using these outlets, it is often necessary to change the location of the outlet, which involves installing a new outlet in the wall, repairing the drywall and repainting at the previous location. This is particularly time-consuming and expensive in the commercial office situation where moves are relatively frequent.

Various systems have been designed to provide a conductive track along which a receptacle may be moved. One of the primary considerations in such a design is that the conductive elements must be guarded against accidental contact by a child or user. For example, U.S. Pat. No. 1,812,956 issued Jul. 7, 1931 to Howk discloses an electrical outlet comprising an elongated housing having a lengthwise slot and a conductor extending along the length of the housing. An electrical receptacle rides along the slot by means of rollers which contact the conductor. The receptacle is not provided with a ground connection as is required in modern electrical systems, and in order to change the position of the receptacle it is necessary to roll it completely around the track from one location to the other. This may cause unnecessary complications where there are a number of receptacles along a track and only one needs to be moved to another location. Further, apparently the Howk receptacle cannot be rigidly secured at the selected location.

Another movable electrical receptacle is disclosed in Kelley U.S. Pat. No. 2,042,105 issued May 26, 1936. Here various means are used to guard the conductors, including a zipper arrangement, a pair of overlapping ribbons and a recessed rib. The same disadvantage noted for the Howk design also apply to these designs.

Other electrical systems permitting the movement of receptacles are shown in U.S. Pat. Nos. 2,076,558; 2,279,383; 2,319,375; 2,617,849; 2,669,632; 3,089,042. These various designs all require the sliding of the receptacle along the track to reach the desired position.

U.S. Pat. No. 4,479,687 issued Oct. 30, 1984 to Electrak International Limited discloses an electrical distribution system in which a specially designed plug may be inserted in any one of a number of apertures along a continuous conductor. However it does not allow for the use of conventional plugs. U.S. Pat. No. 4,690,474 issued Sept. 1, 1987 discloses a safety wall plug in which the plug is slid from the peripheral edge of the wall outlet to the inner edge of a passage in the wall outlet.

It does not permit the movement of the position of the electrical outlet.

There is therefore a need for a continuous electrical distribution system which allows a receptacle to be installed at any location along a track, without requiring that the receptacle be slid from one location to another along the track, and without exposing the conductors to the possibility of contact by a user.

SUMMARY OF THE INVENTION

The present invention provides an electrical distribution system comprising: a) an elongated housing having a front panel defining a hollow interior, and a plurality of parallel elongated slots formed in the front panel, the front panel having an inner and outer surface; b) a plurality of pairs of electrical conduction means fixed to the inner surface of the front panel, each pair of the conduction means being parallel to and spaced from one of the slots; c) means for providing an electrical differential between each the pair of conduction means; and d) a plurality of movable receptacle means for releasably engaging the housing, each receptacle means comprising a face having electrical receptacle means, means for releasably securing the movable receptacle to the housing and means for engaging the conduction means, the conduction engaging means being adapted to engage the conduction means when the receptacle means is installed in one of the slots. The multiple receptacles may include standard electrical outlets, telephone jacks, coaxial cable outlets or other types of electrical outlets.

BRIEF DESCRIPTION OF THE DRAWINGS

In drawings which illustrate a preferred embodiment of the invention.

DETAILED DESCRIPTION OF A PREFERRED EMBODIMENT

Figure 1:
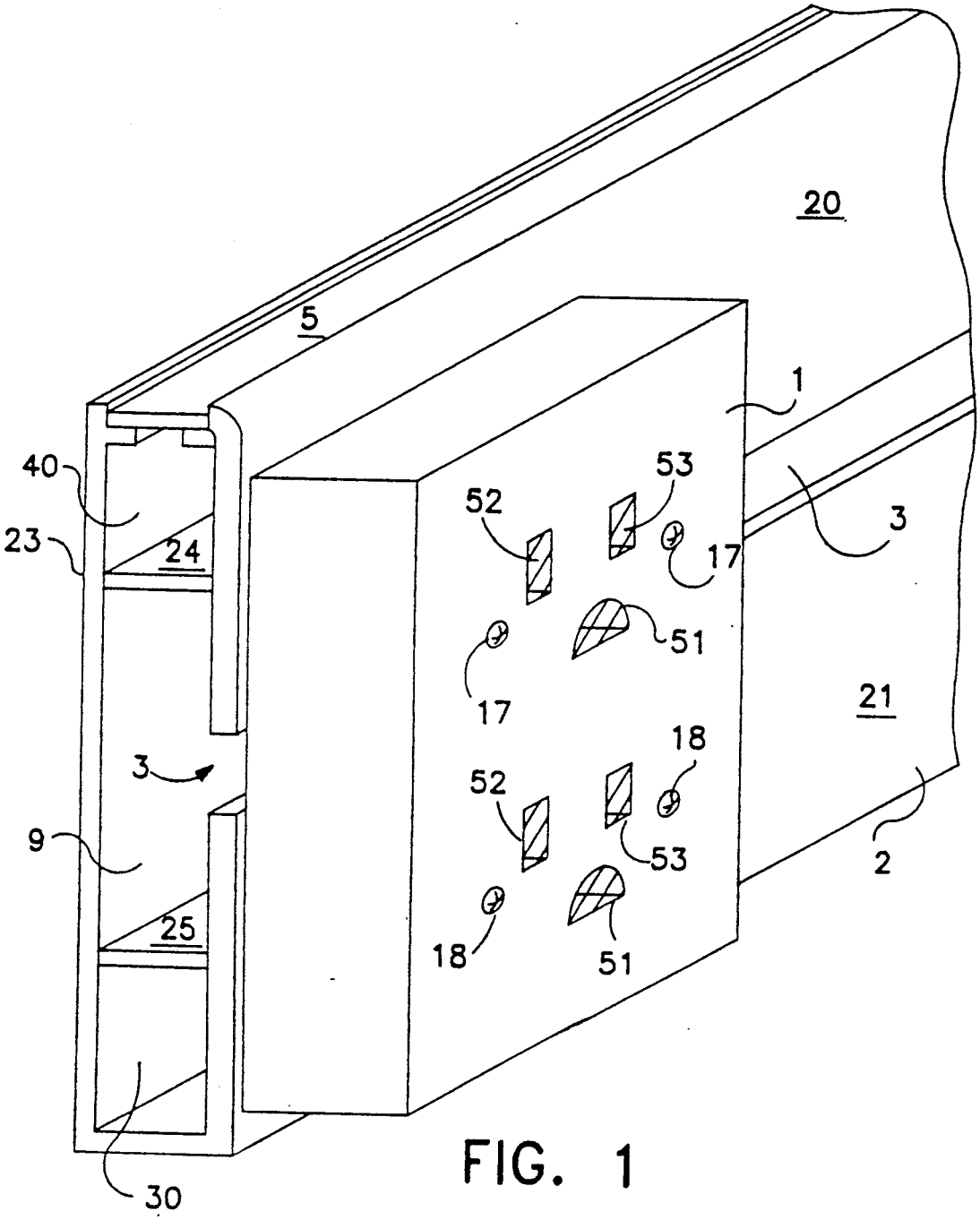
FIG. 1 is an isometric view of the invention.

With reference to FIG. 1, the movable electrical receptacle is designated as 1 and the supporting baseboard structure as 2. Baseboard 2 has an elongated slot 3 in which receptacle 1 seats. Baseboard 2 is constructed to resemble a standard wooden baseboard but in fact is constructed of moulded plastic, bakelite or similar material. It is constructed of a back panel 23, front panels 20 and 21 and horizontal dividers 24 and 25 which separate the hollow interior into compartments 40, 9 and 30 which extend along the length of the baseboard. Compartment 40 serves to hold cables such as telephone, cable television and computer network cables. Compartment 40 is accessible by a removable strip 5.

Figure 2:
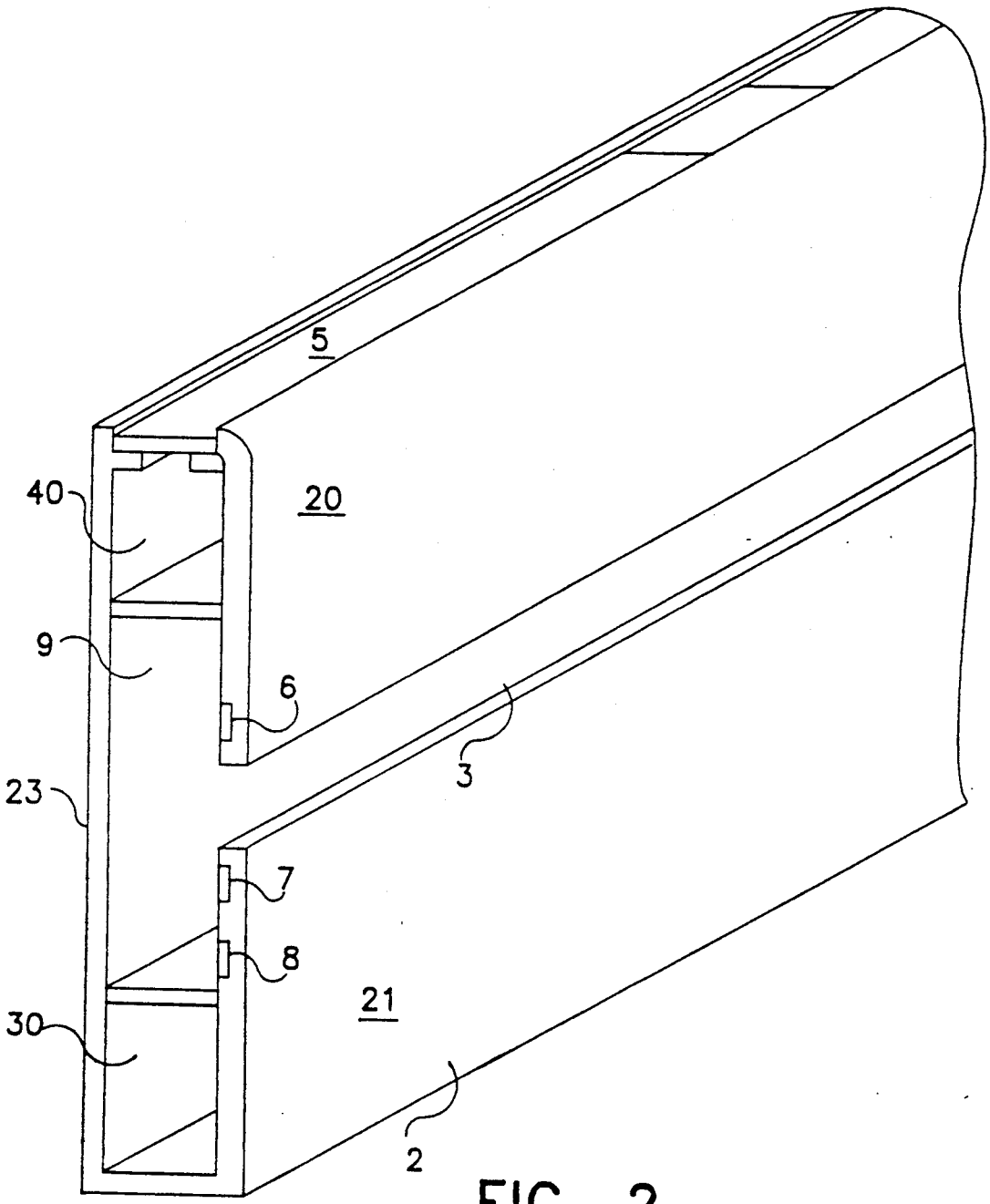
FIG. 2 is an isometric view of the invention as shown in FIG. 1 with the receptacle removed.

As further illustrated in FIG. 2, conductors 6, 7 and 8 are fixed along the inner surface of compartment 9. Conductor 6 preferably carries a positive potential, while conductor 7 is the negative terminal and conductor 8 is grounded. In this way polarized plugs may be used to reduce the possibility of a child accidentally being electrocuted. Slot 3 is preferably about ⅜" wide.

Figure 3:
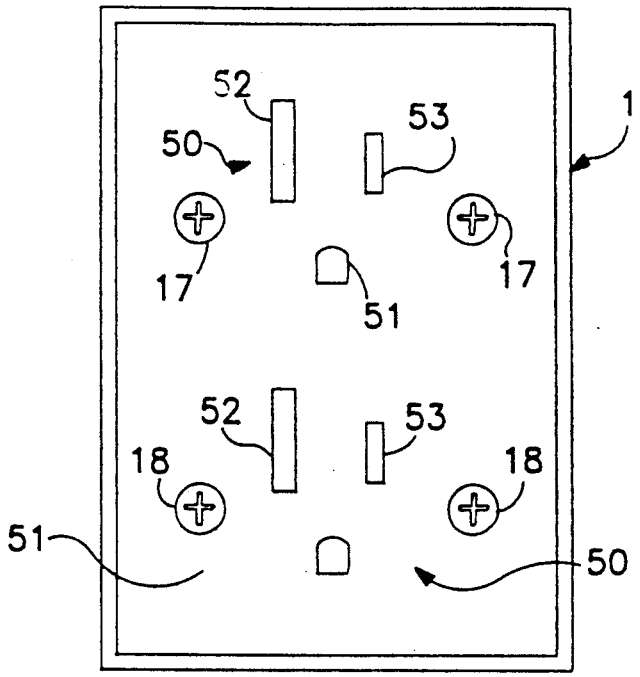
FIG. 3 is a front view of the receptacle shown in FIG. 1.

FIG. 3 illustrates the receptacle in front view, having two polarized plug receptacles 50, consisting of ground receptacle 51, negative receptacle 52 and positive receptacle 53, and four tightening screws 17 and 18.

Figure 4:
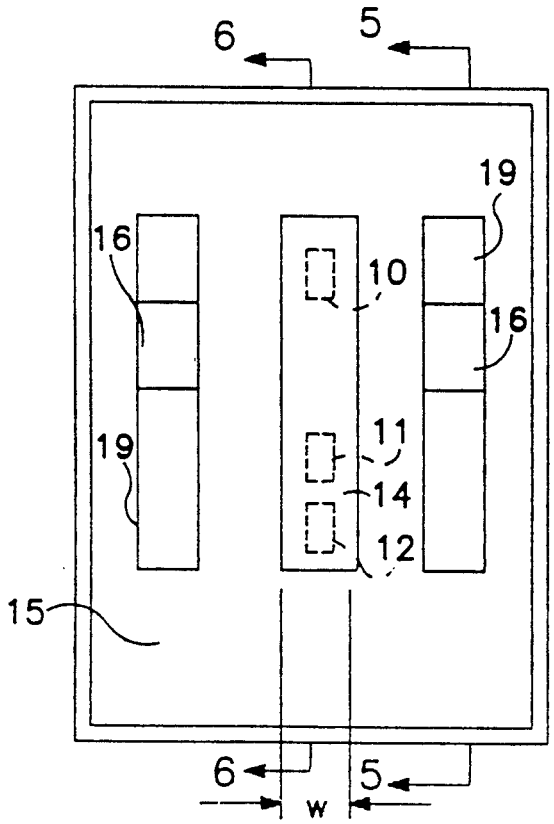
FIG. 4 is a rear view taken of the receptacle shown in FIG. 1.
Figure 5:
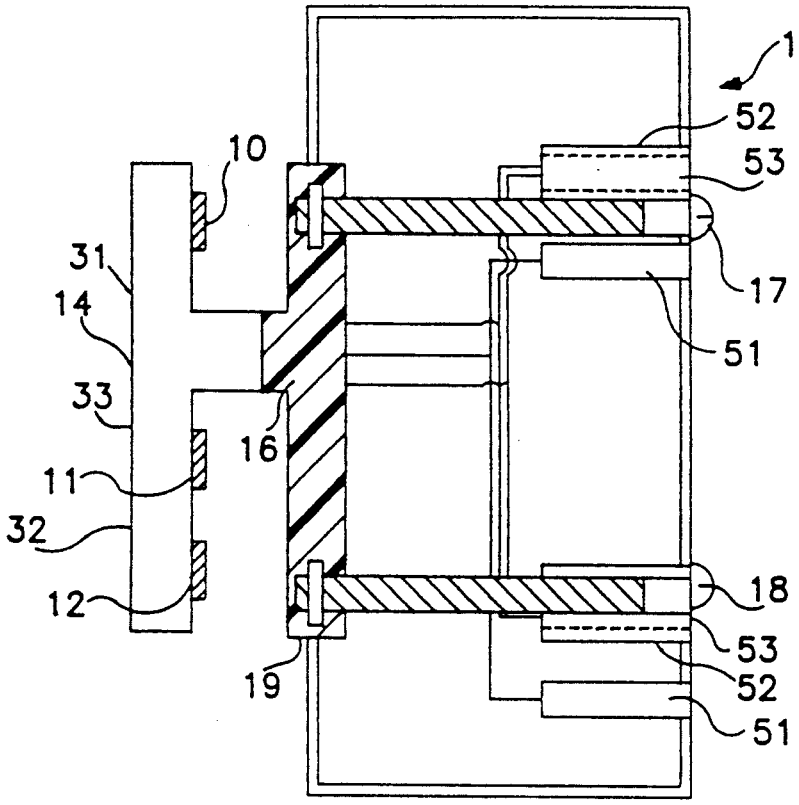
FIG. 5 is a cross-sectional view of the invention shown in FIG. 1 taken along lines 5—5 of FIG. 4.
Figure 6:
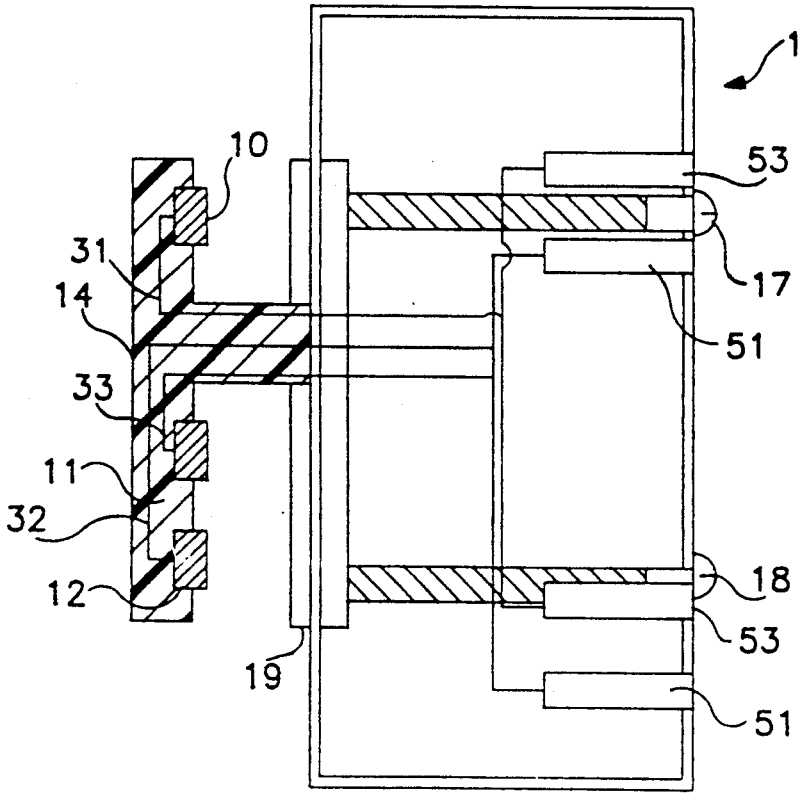
FIG. 6 is a cross-sectional view of the invention shown in FIG. 1 taken along the lines 6—6 of FIG. 4.

As shown in FIGS. 5 and 6, the conductive contacts 10, 11 and 12 are carried on rigid T-shaped assembly 14, and are connected to the plug receptacle via conductors 31, 32 and 33. The dimensions of assembly 14 are chosen so that width w, shown in FIG. 4, is less than the width of slot 3, so that assembly 14 can be inserted through slot 3 and rotated by turning receptacle 1. When rotated through 90 degrees, contacts 10, 11 and 12 then come into firm sliding contact with conductors 6, 7 and 8. The height of the lower part of the T, carrying contacts 11 and 12, is greater than the height of the upper part of the T carrying contact 10. Since similarly the height of the portion of compartment 9 below groove 3 is greater than the height of the portion of compartment 9 above the groove 3, the T-shaped element can only be rotated in such a way that the three conductors are properly aligned with the respective contact.

Once receptacle 1 has been inserted into slot 3 as noted, and rotated to bring the conductors into contact, the receptacle is tightened into place by tightening screws 17 and 18. Bars 19 are threaded to move on screws 17 and 18 as they are rotated and in this way bars 19 are pressed against faces 20 and 21 when the receptacle is in position. Tenon or protrusion 16 is sized to fit snugly in slot 3 when the bar 19 is extended in order to secure the receptacle firmly in position and keep it from wobbling.

To change the position of the receptacle, the screws 17 and 18 are loosened, drawing bars 19 away from baseboard 2 and drawing tenon 16 out of slot 3. The receptacle 1 is then rotated 90 degrees to permit assembly 14 to be withdrawn from slot 3. The receptacle can then be moved to another location on the baseboard.

Figure 7:
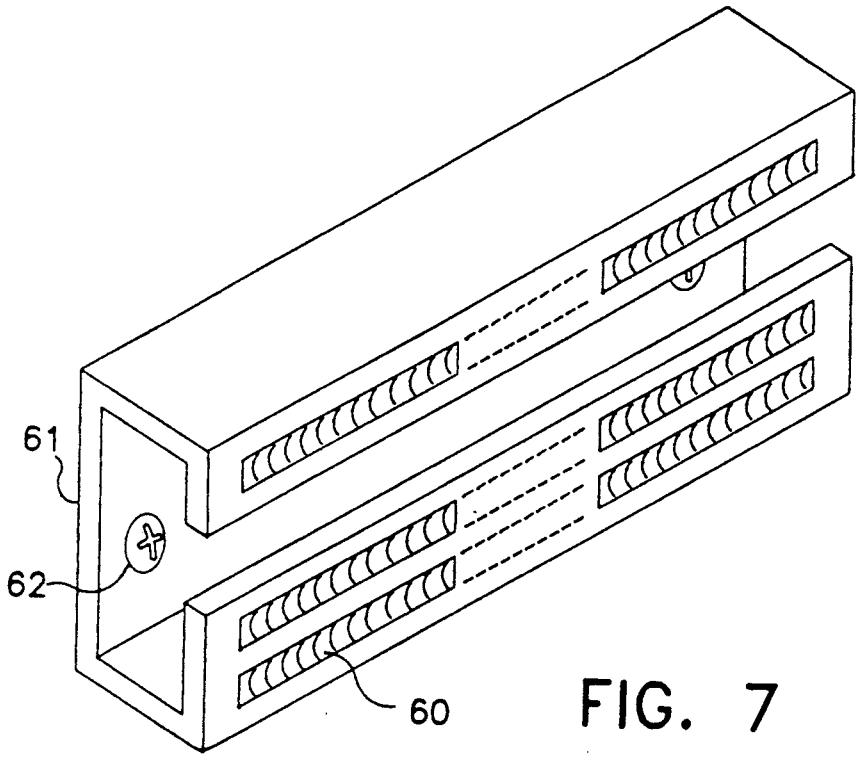
FIG. 7 is an isometric view of a connector piece for connecting the baseboard tracks of the invention.

FIG. 7 illustrates a piece to connect two lengths of the baseboard 2. One end of body 61 slides inside the open end of compartment 9 of one baseboard unit, while the other end of body 61 slides into the similar compartment 9 of the second baseboard unit. The body 61 is secured to each respective baseboard unit 2 using screws 62. Spring type conduction connectors 60 make contact with conductors 6, 7 and 8 of each unit, completing the connection between the corresponding conductor of each unit. The connectors 60 are continuous from one end of the body 61 to the other, but are only exposed at either end to make contact with the conductors in the baseboard units.

Figure 8:
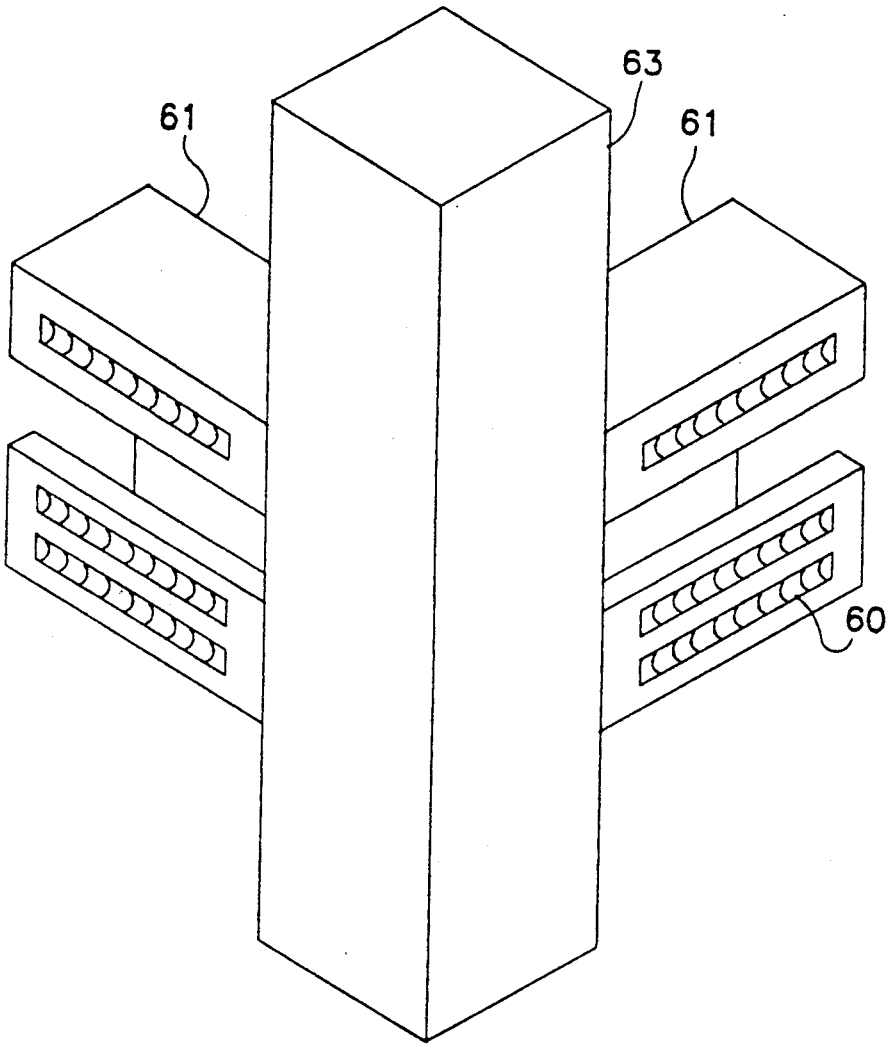
FIG. 8 is an isometric view of a connector piece for connecting the baseboard tracks of the invention at an outside corner.
Figure 9:
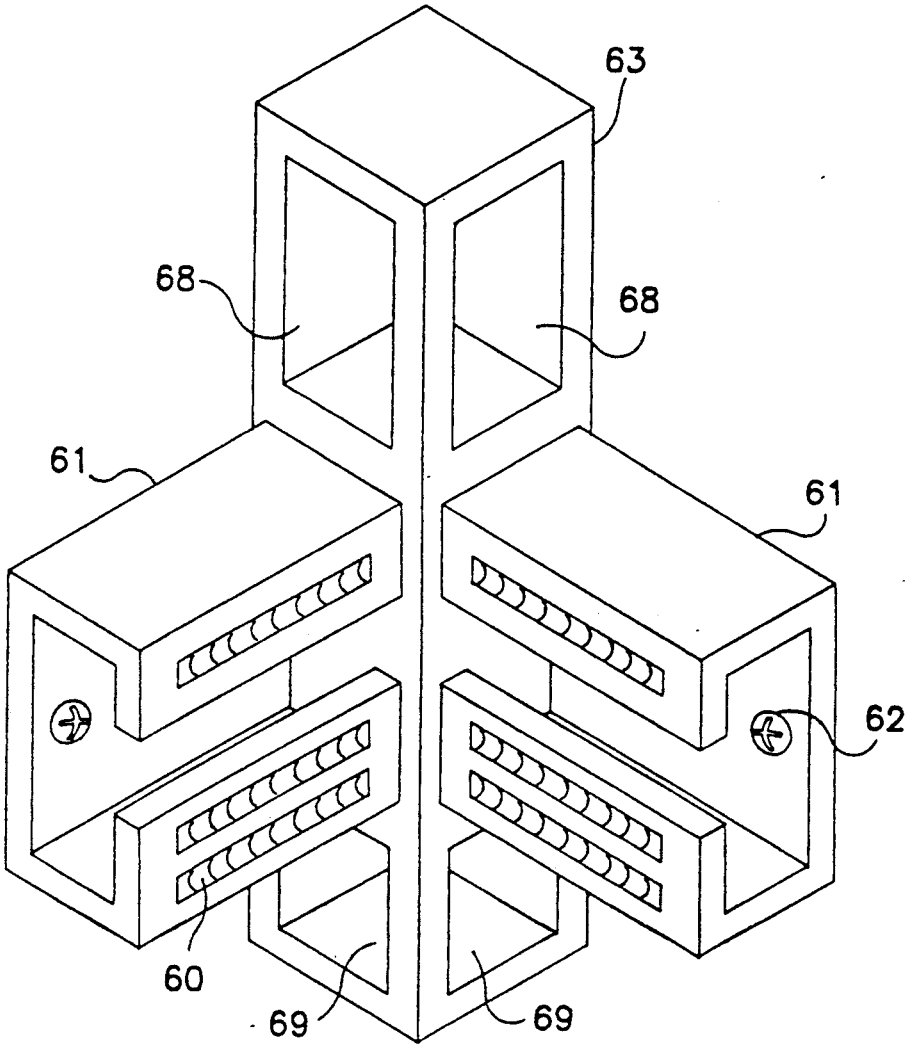
FIG. 9 is an isometric view of a connector piece for connecting the baseboard tracks of the invention at an inside corner.

FIGS. 8 and 9 similarly illustrate connector pieces which allow the baseboard tracks of the invention to span a corner, either with the track on the outside of the corner (FIG. 8) or the inside (FIG. 9). A corner post 63 supports two body units 61 at right angles. Each body unit 61 is constructed as in FIG. 7 to fit into compartment 9 of the respective baseboard units 2, to be secured using screws 62. Connectors 60 contact conductors 6, 7 and 8 to connect them to the corresponding conductor of the other baseboard unit. Apertures 68 and 69 permit continuation of compartments 40 and 30 respectively around the corner.

Figure 10:
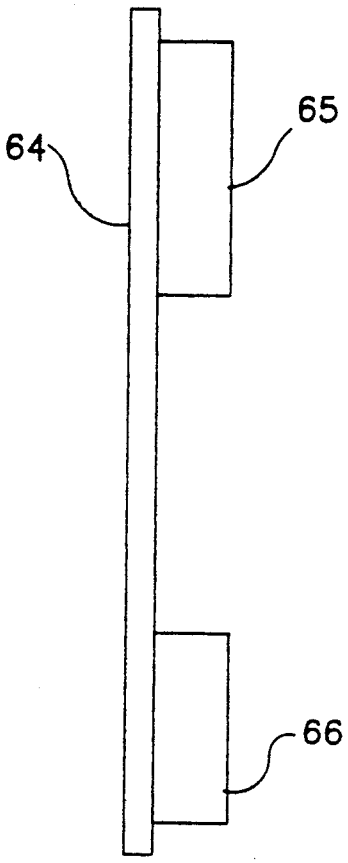
FIG. 10 is a side view of an end cap for the baseboard track units of the invention.

FIG. 10 illustrates an end cap 64 for use to close the ends of a baseboard unit 2 and prevent access to the conductors. It has two rectangular projections 65 and 66 which are inserted in a friction fit into the ends of compartments 30 and 40, and can be glued in place for added security.

Figure 11:
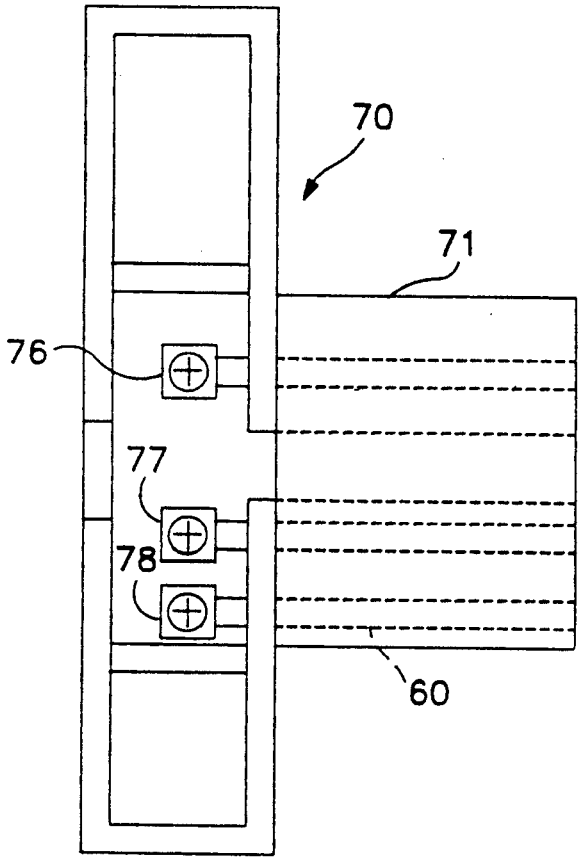
FIG. 11 is a rear view of a power connection end cap for the baseboard track units of the invention.
Figure 12:
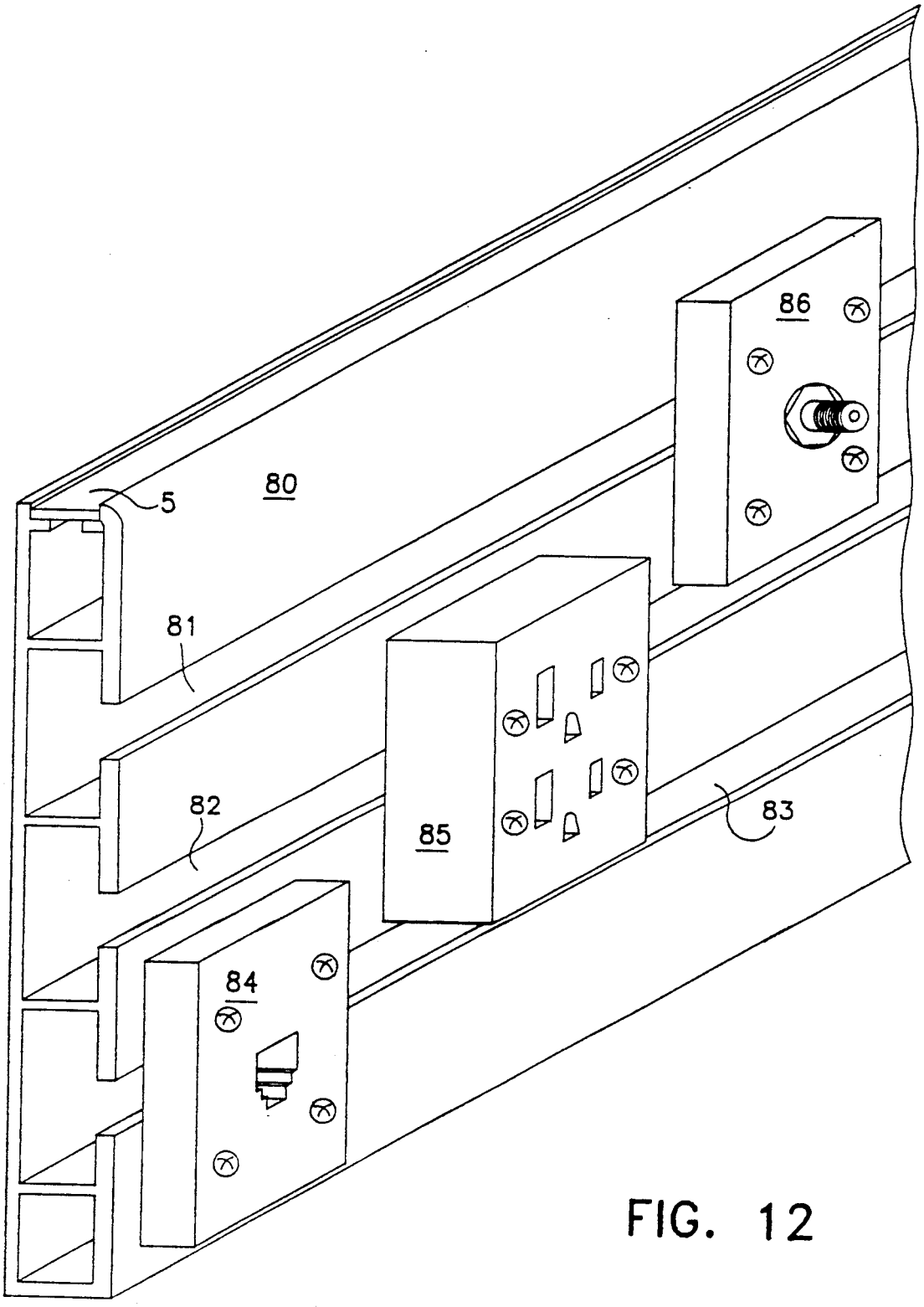
FIG. 12 is an isometric view of the invention with telephone, electrical and television receptacles.

FIG. 11 illustrates an end cap 70 for power connection. Extension 71 slides into the open end of compartment 9 of the baseboard unit 2 of interest. Connectors 60 make contact with the conductors 6, 7 and 8, and the ends of these conductors are connected to terminals 76, 77 and 78 for connection of an electrical power source to power the baseboard track units of the invention.

While the invention has been described using conductors to carry electrical power, similar construction could be used for the telephone circuit. The coaxial cables are carried in compartment 40.

Figure 13:
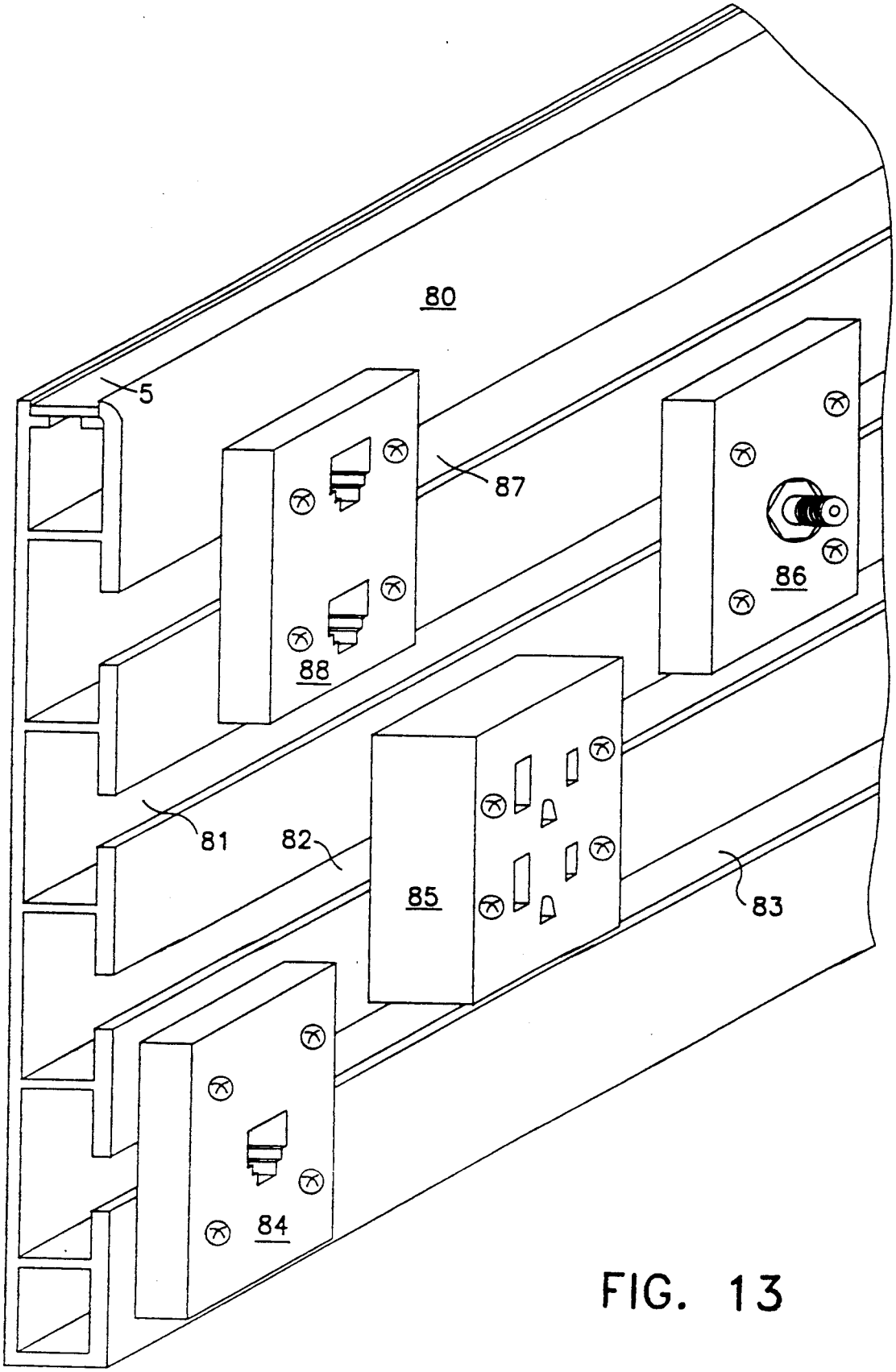
FIG. 13 is an isometric view of the invention shown in FIG. 12 with an additional duplex receptacle.
Figure 14:
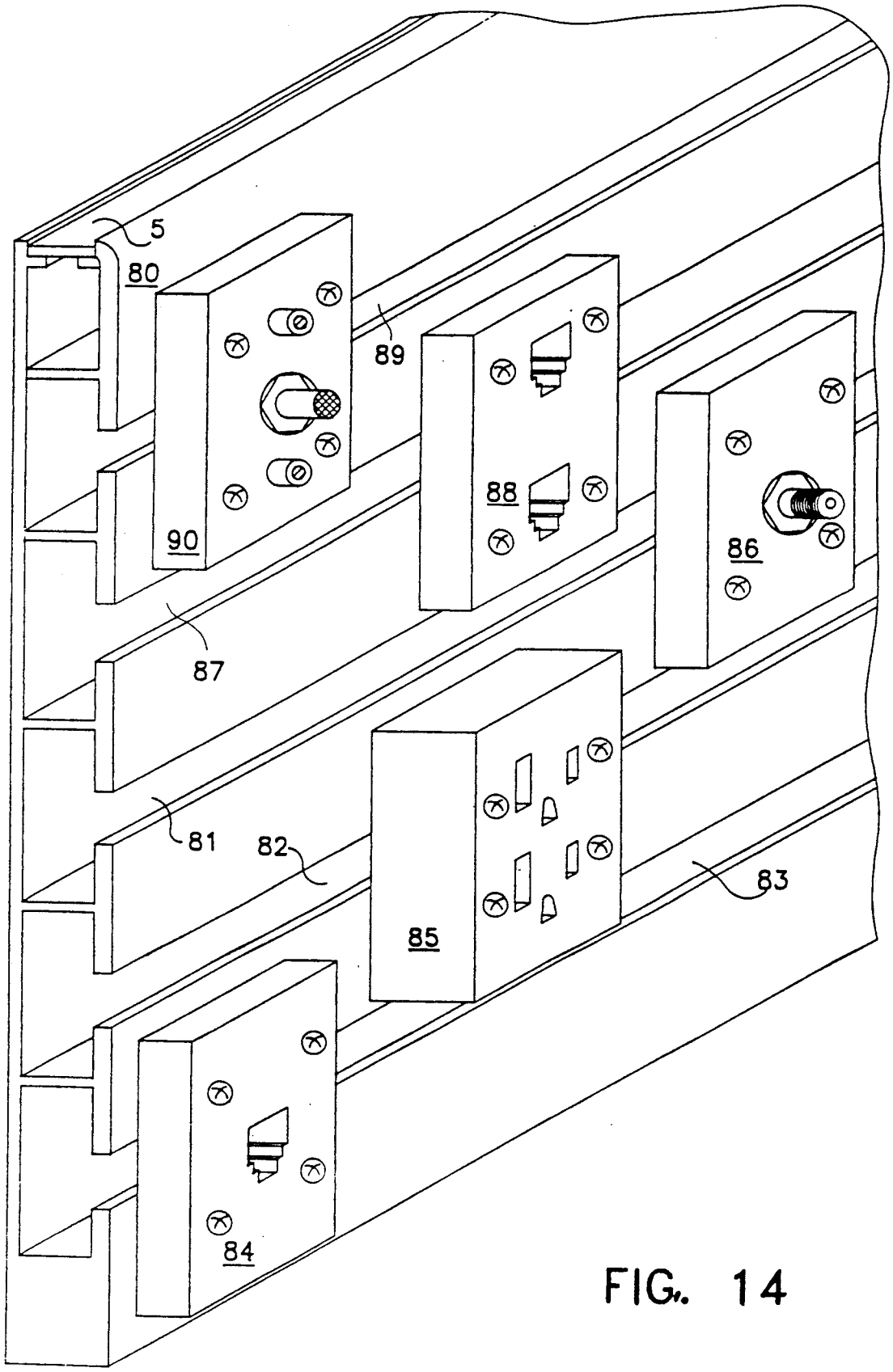
FIG. 14 is an isometric view of the invention shown in FIG. 13 with an additional audio receptacle.
Figure 15:
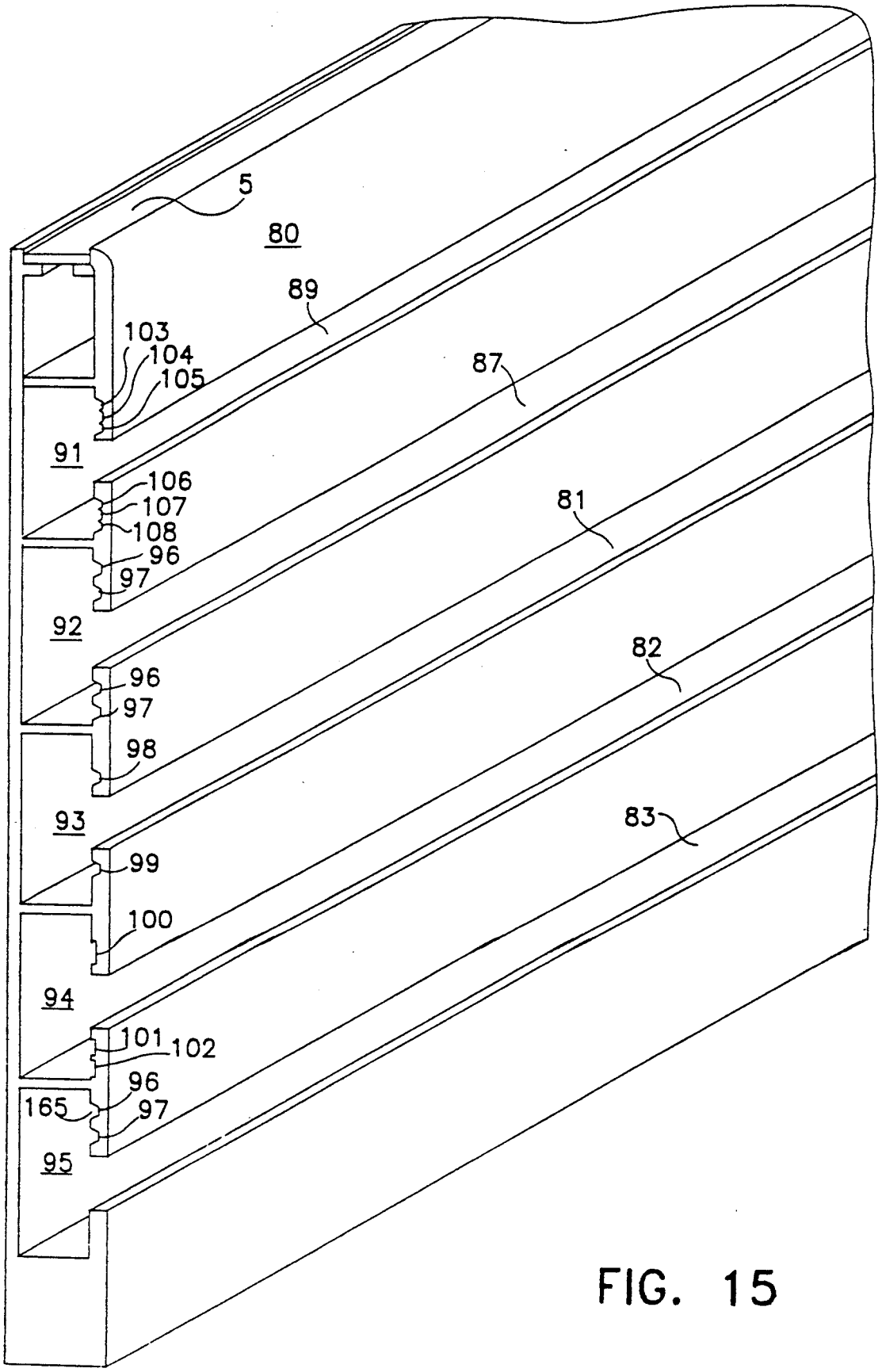
FIG. 15 is an isometric view of the invention as shown in FIG. 14 with the receptacles removed.

FIGS. 12 through 15 illustrate embodiments of the invention with multiple raceways for telephone, electrical and television receptacles. Baseboard 80 has slots 81, 82 and 83 for receiving telephone receptacle 84, electrical receptacle 85 (same as receptacle 1 above) and coaxial television receptacle 86. FIG. 13 illustrates a further variation of the invention shown in FIG. 12 with an additional slot 87 for a duplex receptacle 88. FIG. 14 illustrates yet a further extension of the invention shown in FIG. 13 with an additional slot 89 for receiving an audio receptacle 90. FIG. 15 illustrates the multiple raceway shown in FIG. 14 with the receptacles removed. Appropriate conductors are provided along the inner surface of compartments 91, 92, 93, 94 and 95 for the particular type of receptacle—adjacent pairs 96, 97 for telephone, two pairs 96, 97 separated by slot 87 for duplex receptacle 88, separated pairs 98, 99 for coaxial (which requires greater shielding), electrical conductors and ground 100, 101, 102 as above, and combination of pairs 103, 104, and 107, 108, and separated pairs 105, 106 for audio.

Figure 16:
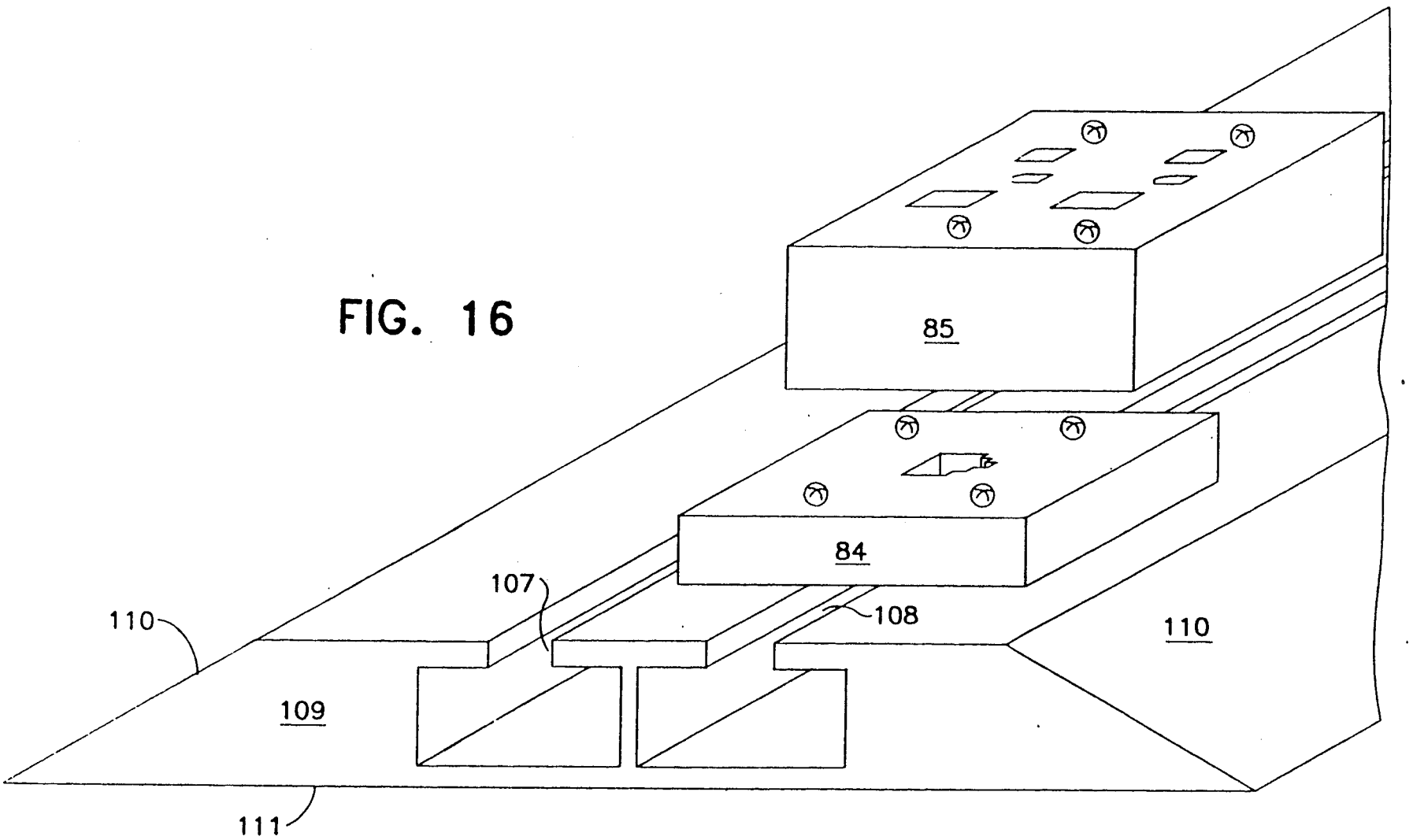
FIG. 16 is an isometric view a floor raceway according to the invention.
Figure 17:
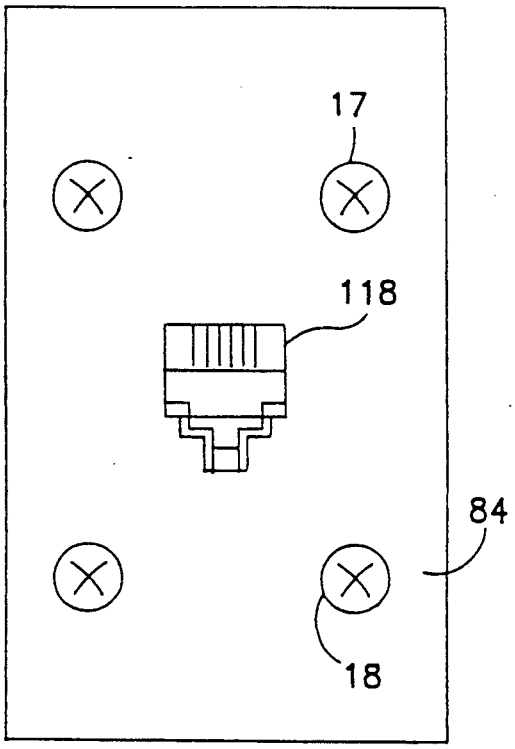
FIG. 17 is a front view of the telephone receptacle.
Figure 18:
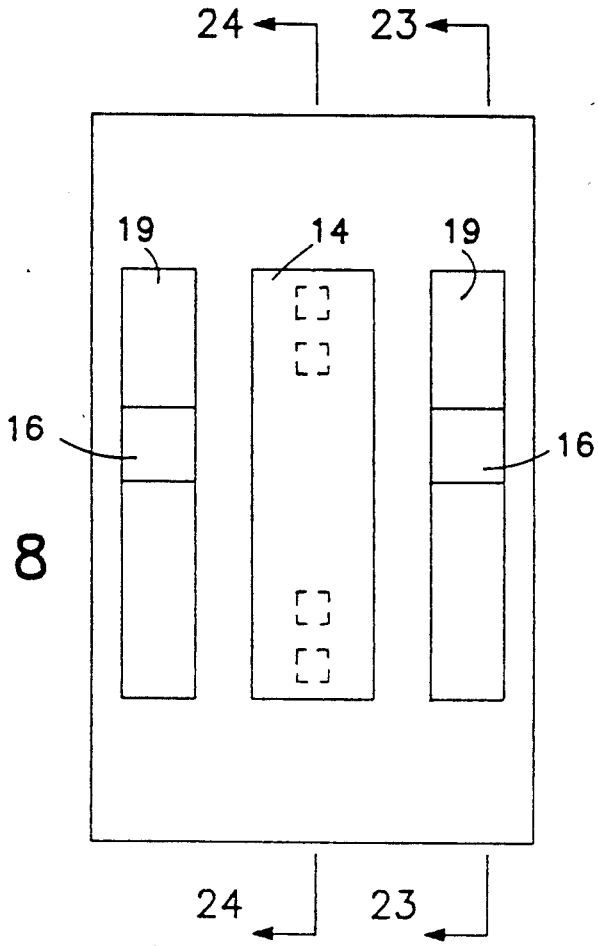
FIG. 18 is a rear view of the telephone receptacle.
Figure 19:
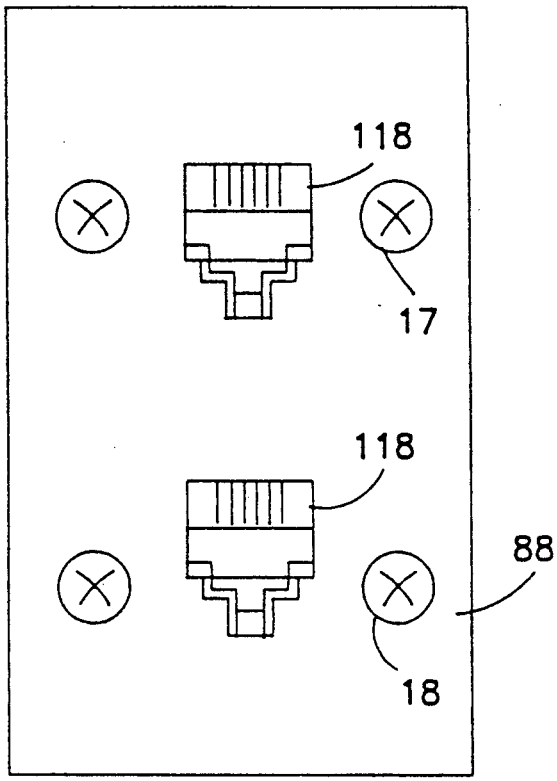
FIG. 19 is a front view of the duplex receptacle.
Figure 20:
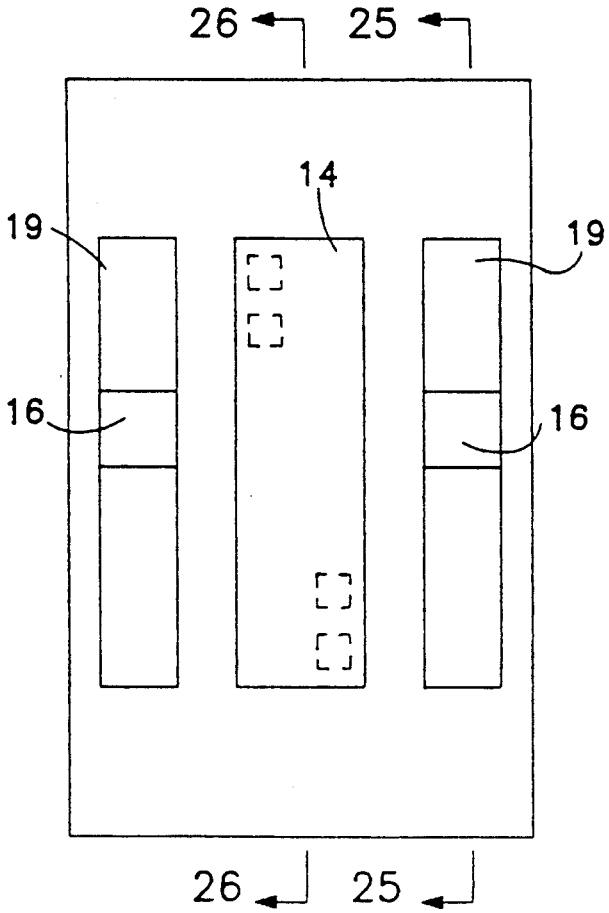
FIG. 20 is a rear view of the duplex receptacle.
Figure 21:
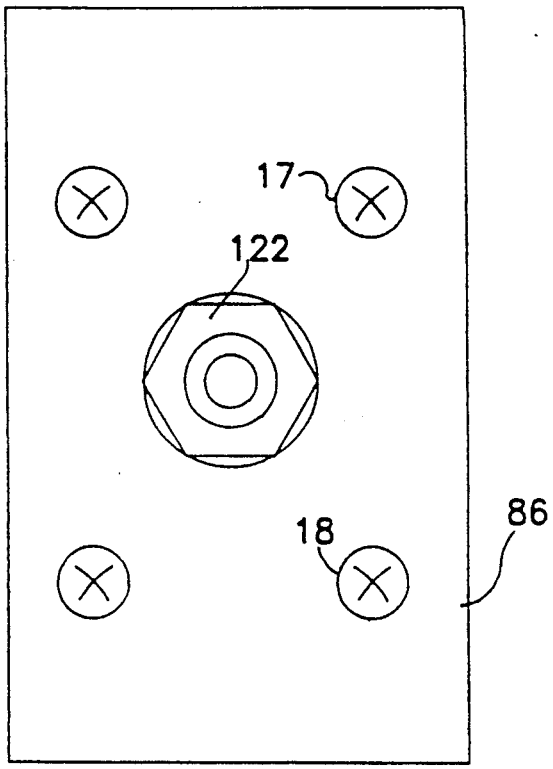
FIG. 21 is a front view of the television receptacle.
Figure 22:
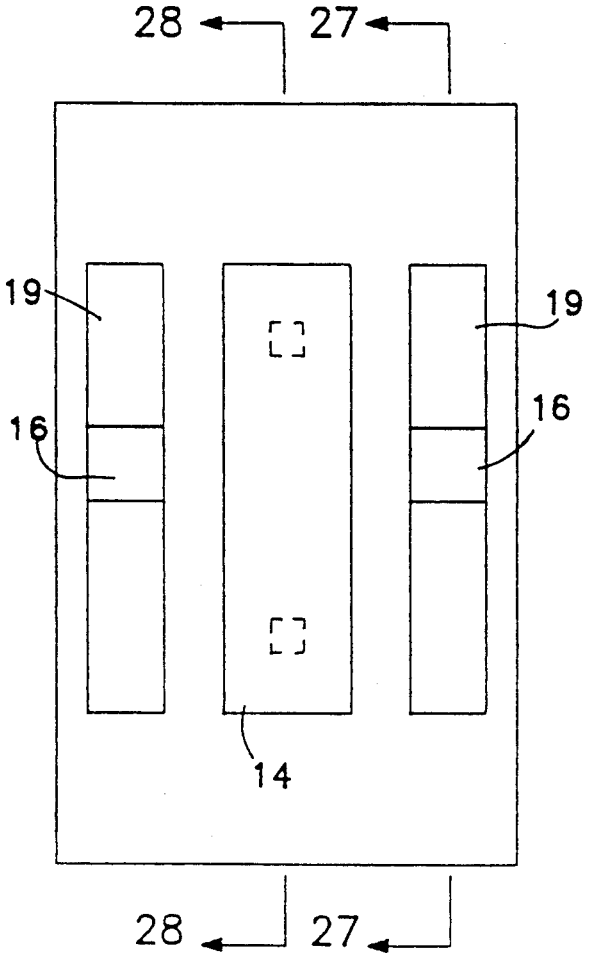
FIG. 22 is a rear view of the television receptacle.
Figure 48:
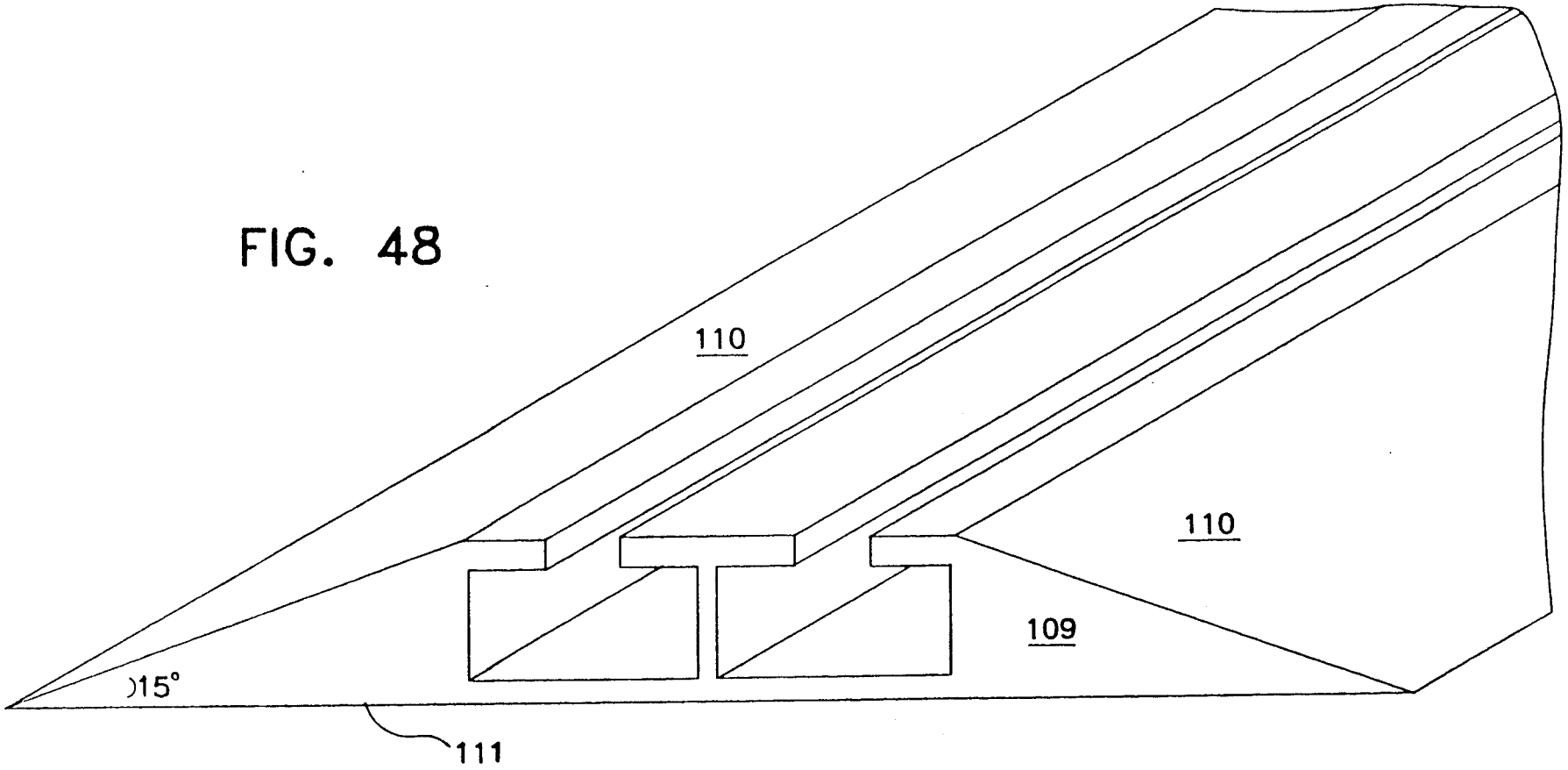
FIG. 48 is an isomeric view of a floor raceway.
Figure 49:
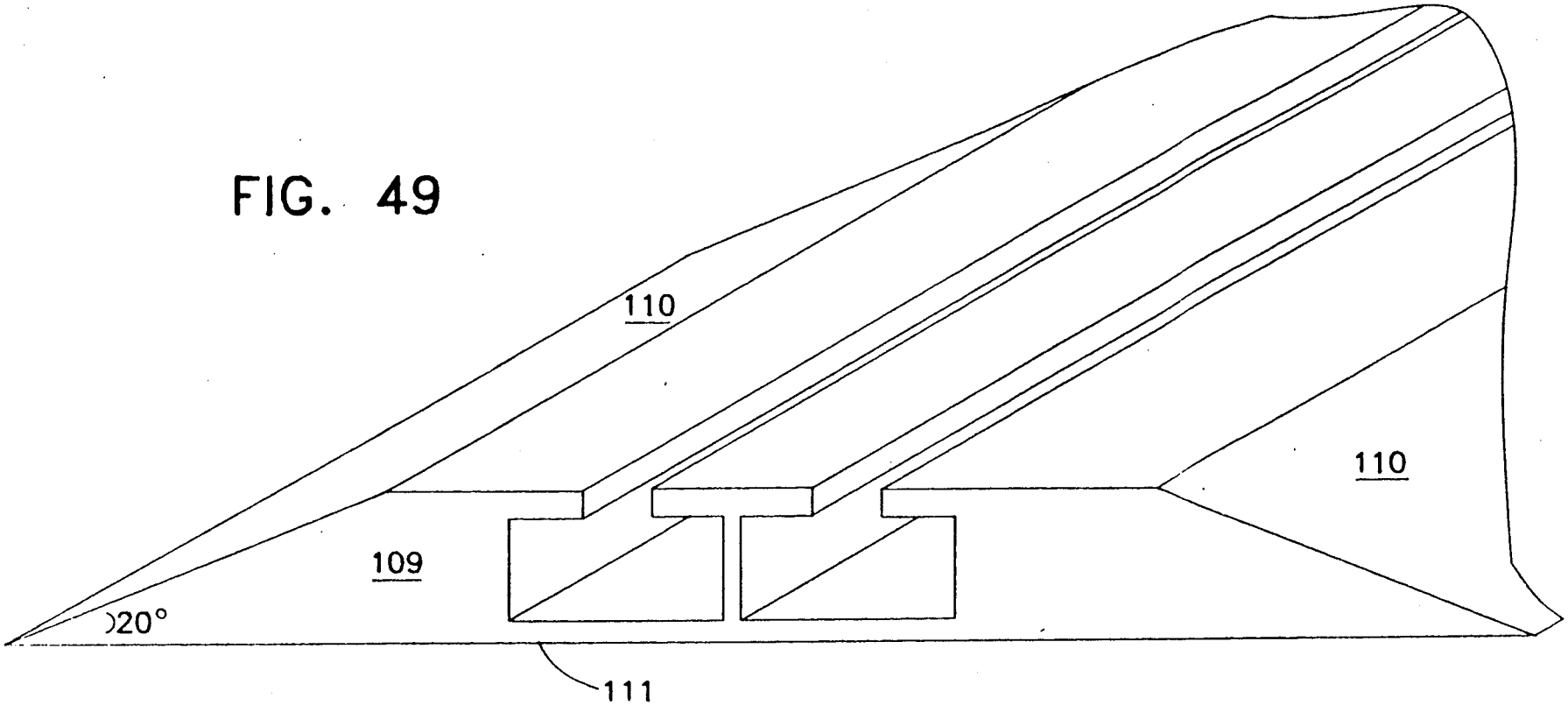
FIG. 49 is an isometric view of a second floor raceway.
Figure 50:
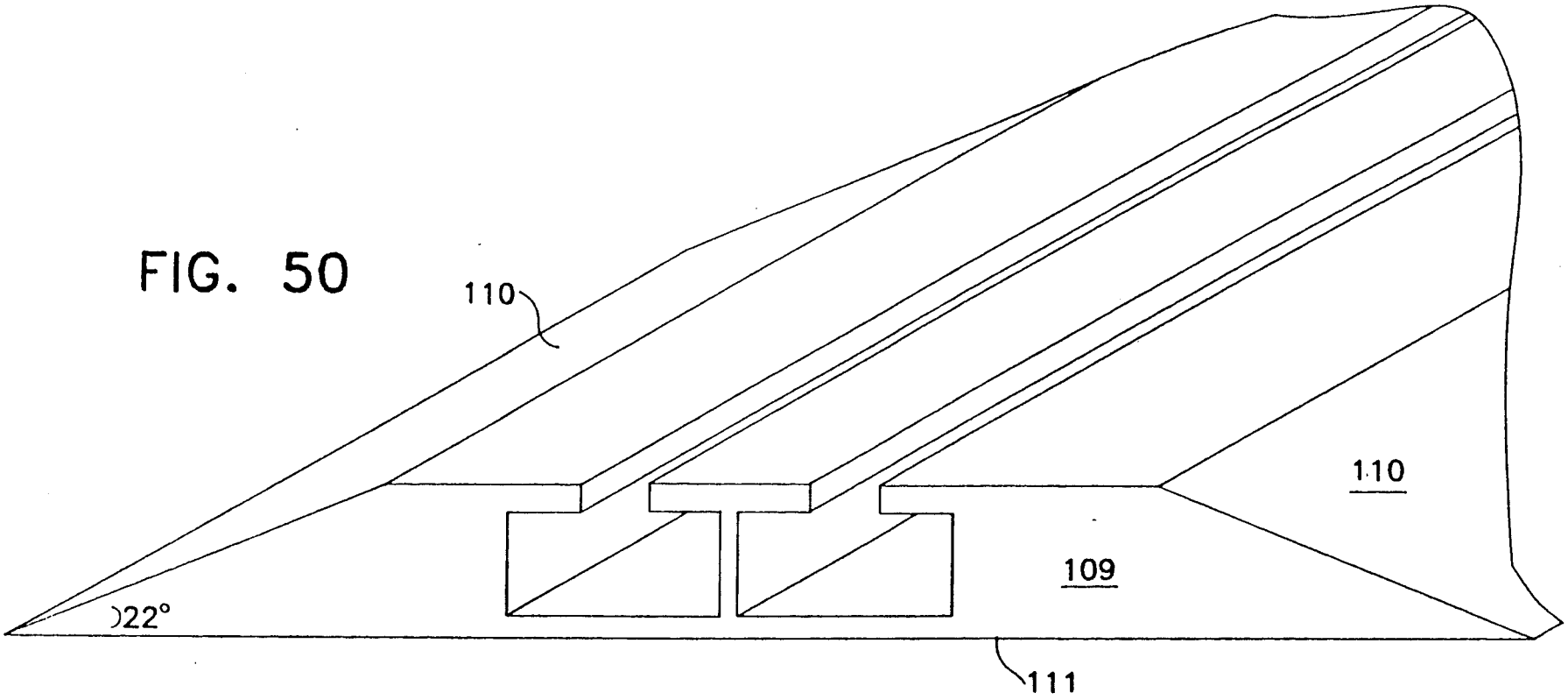
FIG. 50 is an isometric view of a second floor raceway.

FIG. 16 illustrates a floor raceway according to the invention, having electrical and telephone receptacles 84, 85 as above which slide in slots 107, 108 in base 109. Base 109 has sloping sides 110 which present a surface over which wheels can roll and on which people are less likely to trip. FIGS. 48, 49 and 50 illustrate three variations of this design in which the angle formed by face 110 with the bottom 111 of base 109 (which lies flush on the floor) is 15 degrees, 20 degrees and 22 degrees respectively. While FIG. 14 illustrate use of electrical and telephone receptacles, it will be apparent that the various other movable receptacles described herein could also be used.

Figure 23:
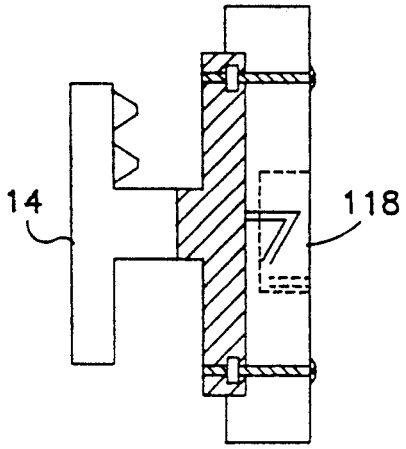
FIG. 23 is a cross-sectional view of the telephone receptacle shown in FIG. 17 taken along lines 23—23 of FIG. 18.
Figure 24:
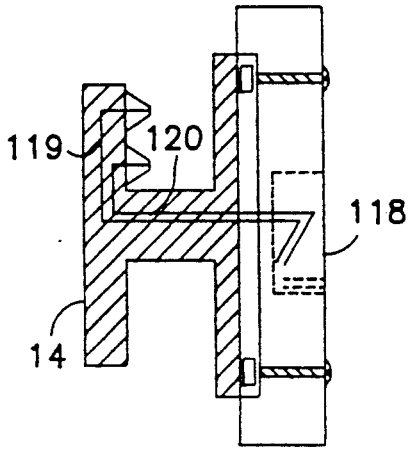
FIG. 24 is a cross-sectional view of the telephone receptacle shown in FIG. 17 taken along lines 24—24 of FIG. 18.
Figure 25:
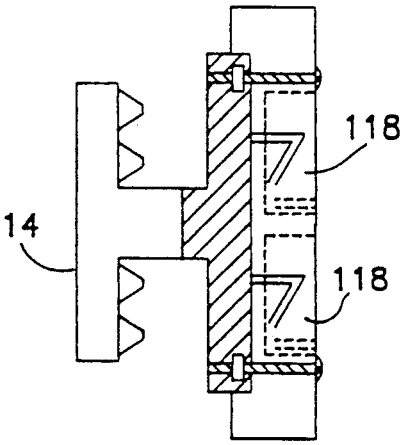
FIG. 25 is a cross-sectional view of the duplex receptacle shown in FIG. 19 taken along lines 25—25 of FIG. 20.
Figure 26:
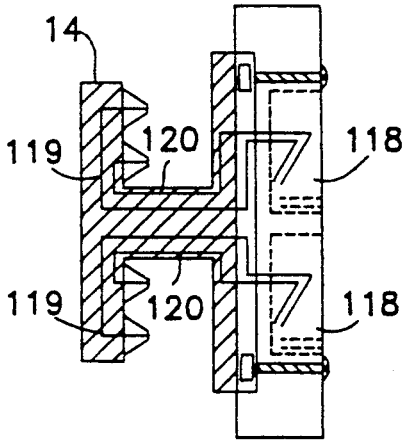
FIG. 26 is a cross-sectional view of the duplex receptacle shown in FIG. 19 taken along lines 26—26 of FIG. 20.
Figure 27:
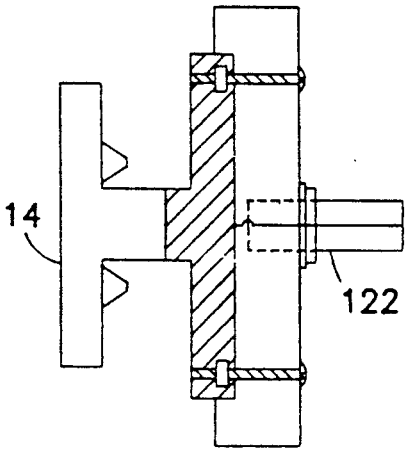
FIG. 27 is a cross-sectional view of the television receptacle shown in FIG. 21 taken along lines 27—27 of FIG. 22.
Figure 28:
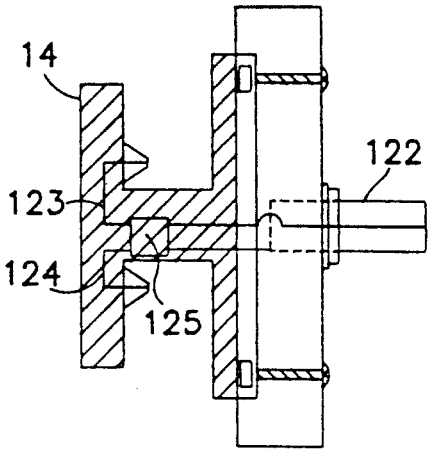
FIG. 28 is a cross-sectional view of the television receptacle shown in FIG. 21 taken along lines 28—28 of FIG. 22.
Figure 29:
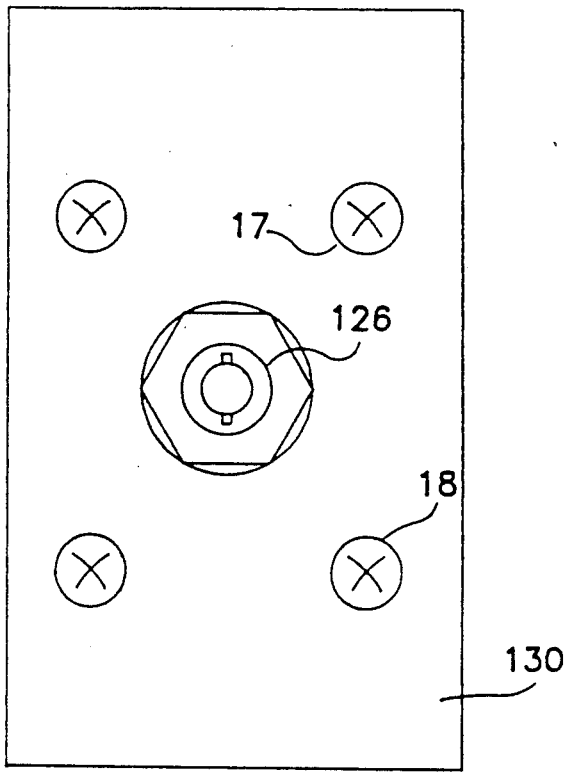
FIG. 29 is a front view of a computer receptacle.
Figure 30:
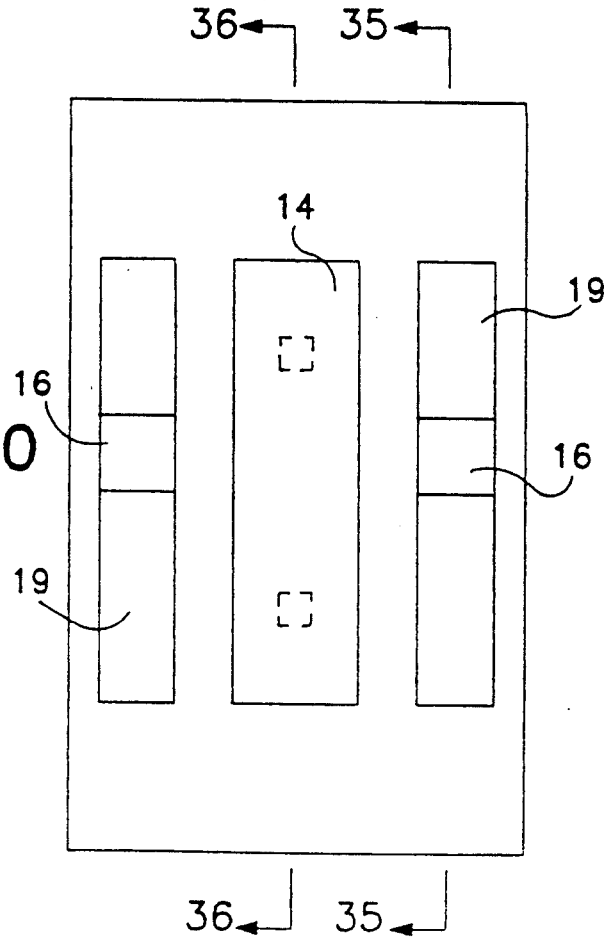
FIG. 30 is a rear view of the computer receptacle.
Figure 31:
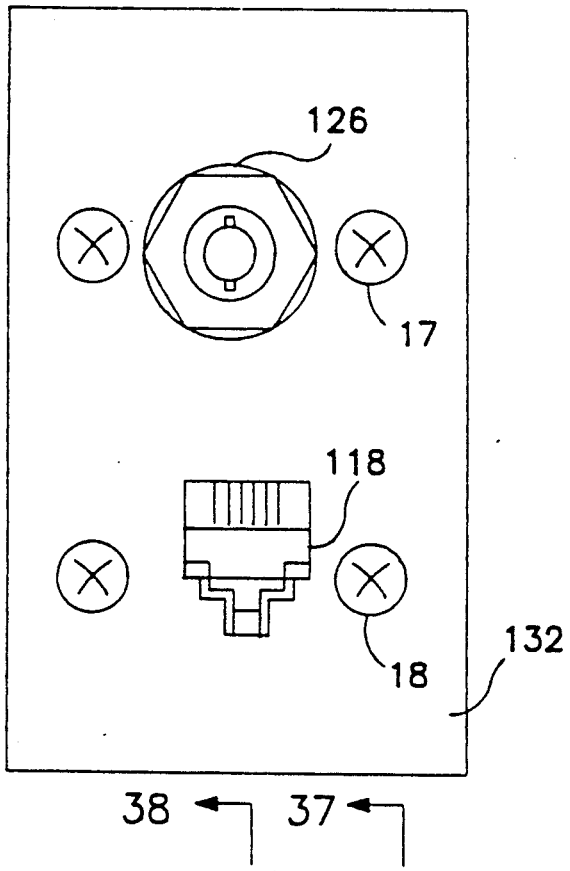
FIG. 31 is a front view of the computer coaxial telephone receptacle.
Figure 32:
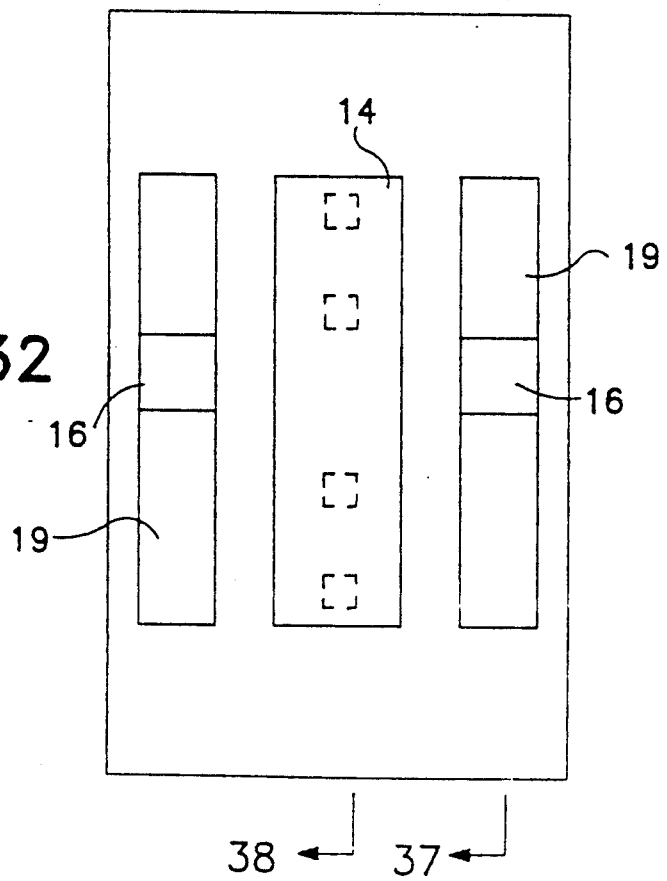
FIG. 32 is a rear view of the computer coaxial telephone receptacle.
Figure 33:
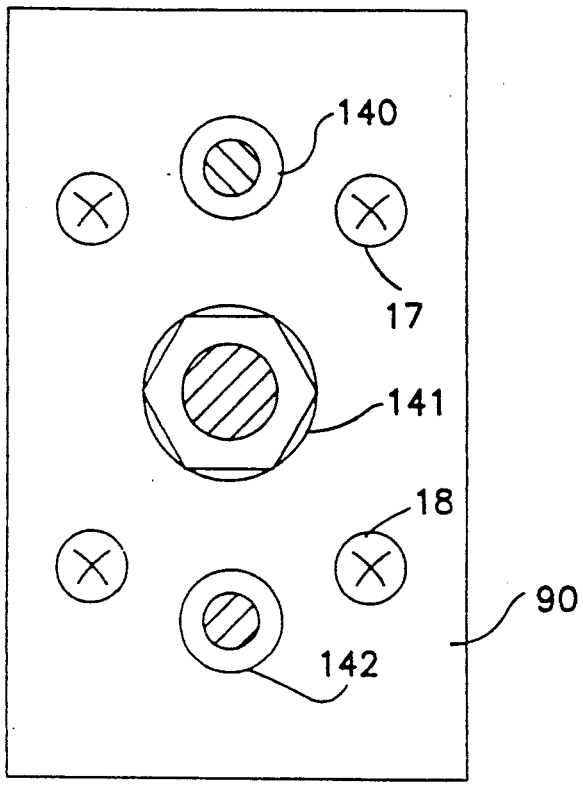
FIG. 33 is a front view of the audio receptacle.
Figure 34:
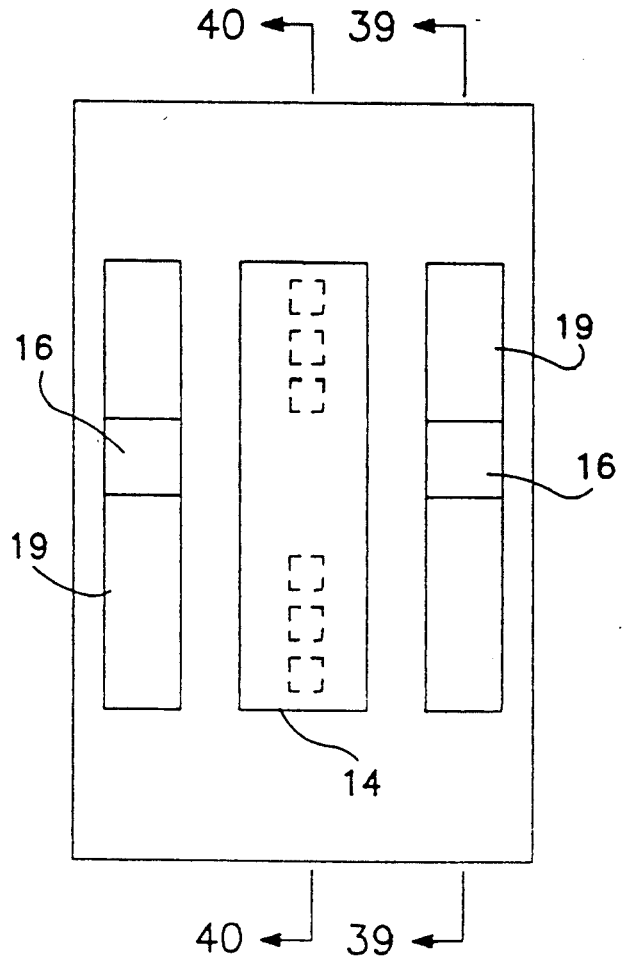
FIG. 34 is a rear view of the audio receptacle.
Figure 35:
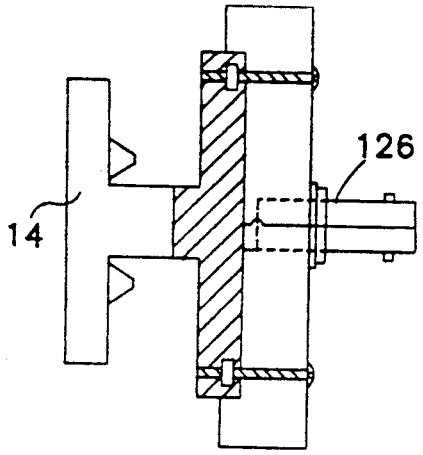
FIG. 35 is a cross-sectional view of the computer receptacle shown in FIG. 29 taken along lines 35—35 of FIG. 30.
Figure 36:
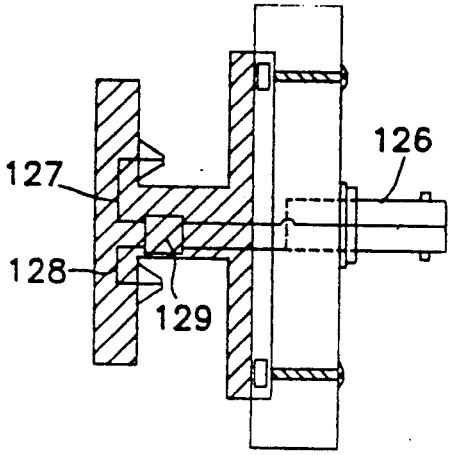
FIG. 36 is a cross-sectional view of the computer receptacle shown in FIG. 29 taken along lines 36—36 of FIG. 30.
Figure 37:
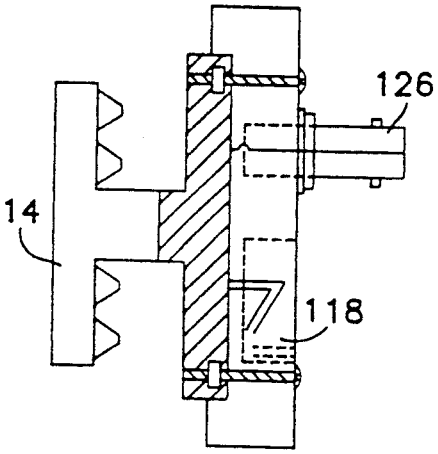
FIG. 37 is a cross-sectional view of the duplex computer/telephone receptacle shown in FIG. 31 taken along lines 37—37 of FIG. 32.
Figure 38:
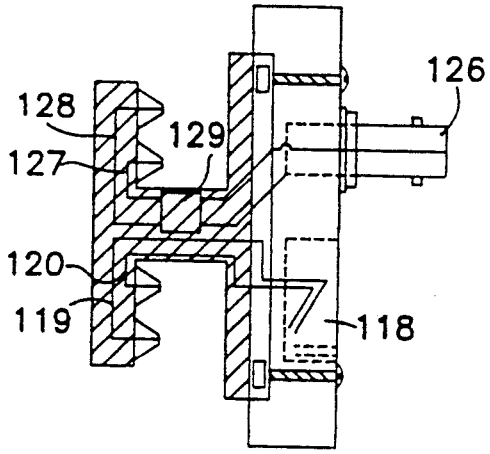
FIG. 38 is a cross-sectional view of the duplex computer/telephone receptacle shown in FIG. 19 taken along lines 38—38 of FIG. 32.
Figure 39:
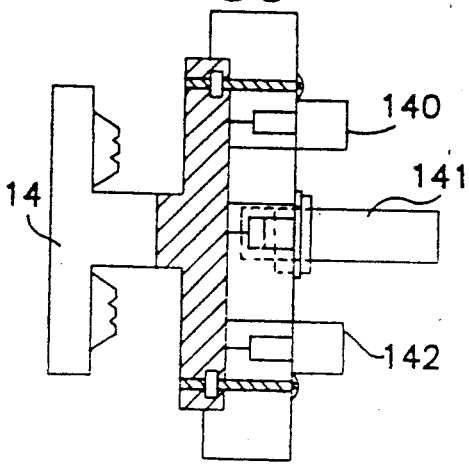
FIG. 39 is a cross-sectional view of the audio receptacle shown in FIG. 33 taken along lines 39—39 of FIG. 34.
Figure 40:
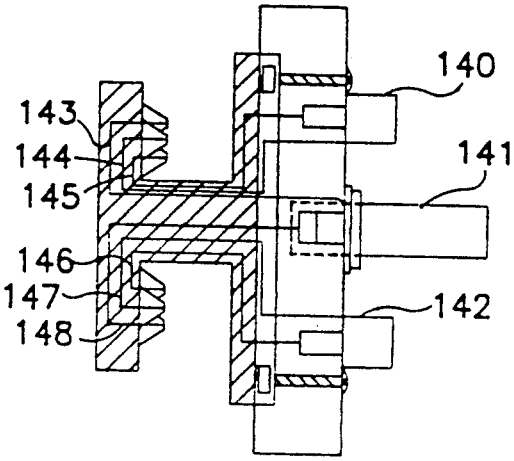
FIG. 40 is a cross-sectional view of the audio receptacle shown in FIG. 33 taken along lines 40—40 of FIG. 34.

The basic structure of the various movable receptacles used in the multiple raceway system is the same as for the single electrical raceway embodiment described above (1 in FIG. 1, and 85 in FIG. 12), with the alterations made to accommodate the different electrical connections. Otherwise the receptacles include the same T-shaped assembly 14, and bars 19, movable on screws 17 and 18 and having tenons 16 which fit in the respective slots. While two screws for each bar 19 are shown, a single adjustment screw 18 could be used for each bar 19. It is important that individual raceways are shielded from each other to minimize distortion, noise and cross-talk. Also, each wire cell is preferably shielded so electrical interference between wires is minimized. For this reason the conductors are preferably recessed in grooves 165 (FIG. 15) and the connecting elements 166 (FIG. 23) are conical projections.

FIGS. 17, 18, 23 and 24 illustrate the telephone receptacle 84, having a telephone jack 118 and conductors 119, 120. FIGS. 19, 20, 25 and 26 illustrate the duplex receptacle 88 having two telephone jacks 118. FIGS. 21, 22, 27 and 28 illustrate the coaxial television receptacle 86 having a coaxial cable jack 122, conductors 123 and 124 and balun 125. Each coaxial receptacle requires a balun between the coaxial line and the raceway system for balancing.

FIGS. 29, 30, 35 and 34 illustrate a computer receptacle 130 having a coaxial jack 124, conductors 127, 128 and balun 129. FIGS. 31, 32, 37 and 38 illustrate a computer coaxial telephone receptacle 132 including both the coaxial jack 126 and telephone jack 118. FIGS. 33, 34, 39 and 40 illustrate an audio receptacle 90 having jacks 140, 141 and 142 and conductors 143, 144, 145, 146, 146 and 148.

Figure 41:
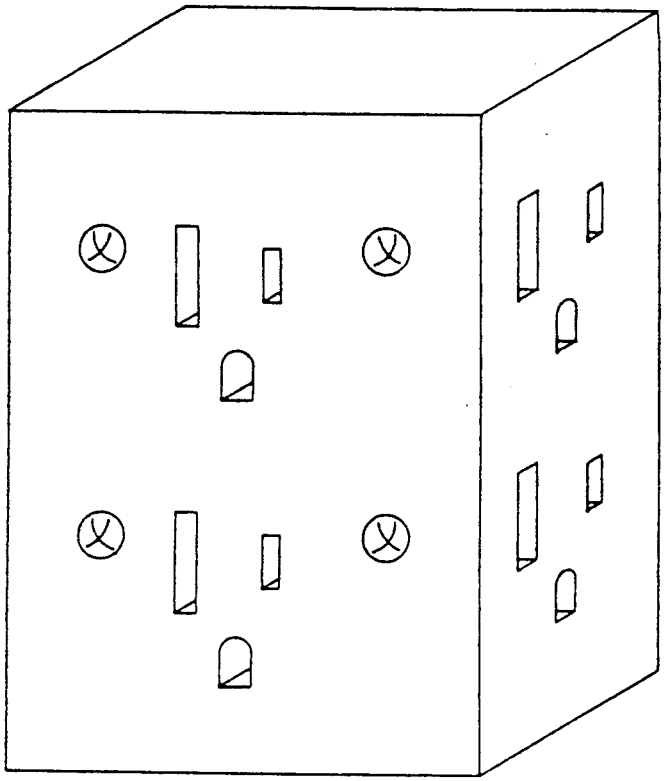
FIG. 41 is an isometric view of a multiple power receptacle.
Figure 42:
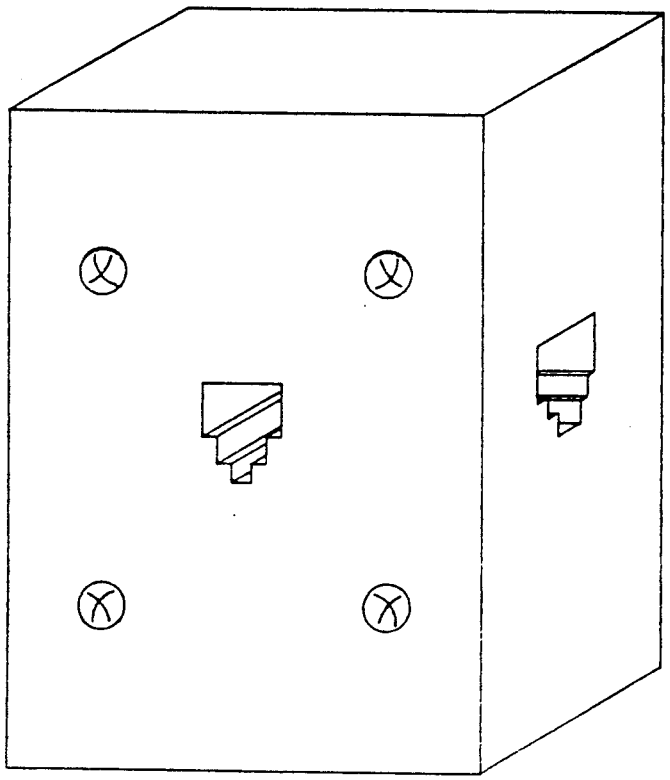
FIG. 42 is an isometric view of a multiple telephone receptacle.
Figure 51:
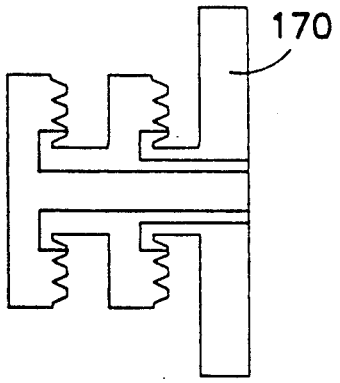
FIG. 51 is a cross-sectional view of an expansion connector.
Figure 52:
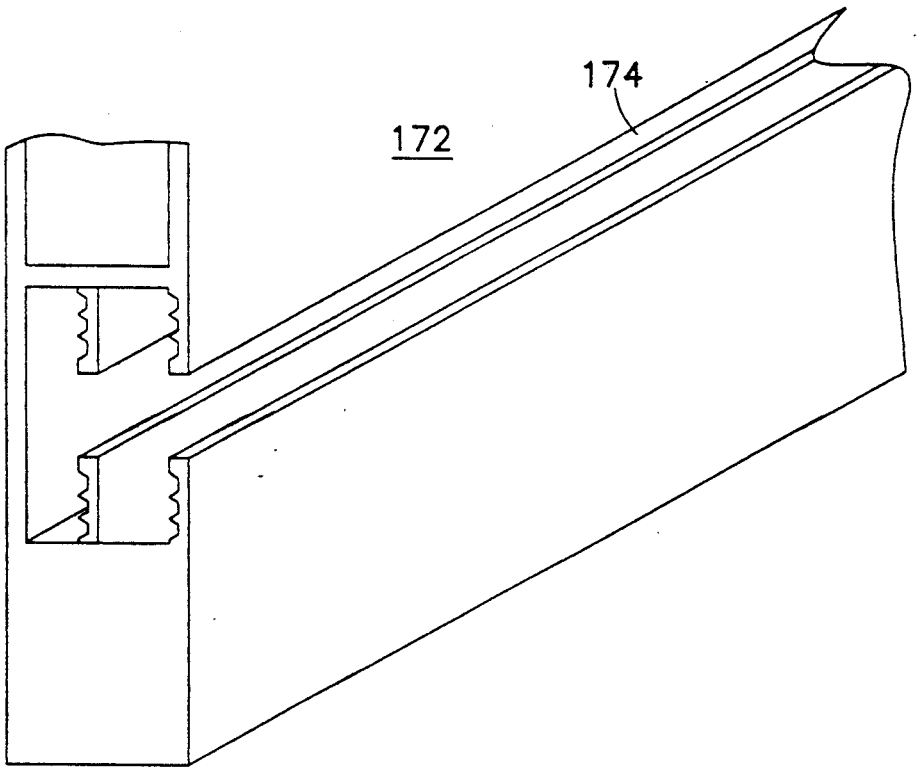
FIG. 52 is an isometric view of an expansion raceway.

FIG. 41 illustrates a multiple power receptacle and FIG. 42 illustrates a multiple telephone receptacle. As shown in FIGS. 51, 52 below, up to six lines (12 conductors) can be accommodated on one receptacle, which can be configured as shown in FIGS. 41, 42, and otherwise the means of connection to the raceway is as for the single line receptacle.

Figure 43:
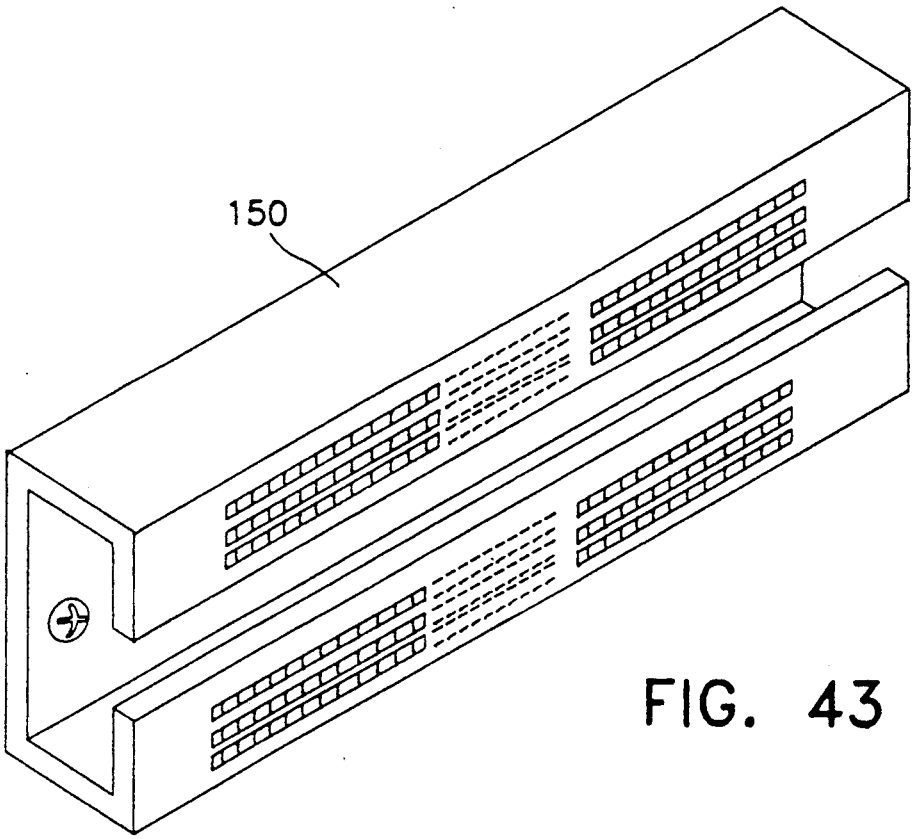
FIG. 43 is an isometric view of a connector piece.
Figure 44:
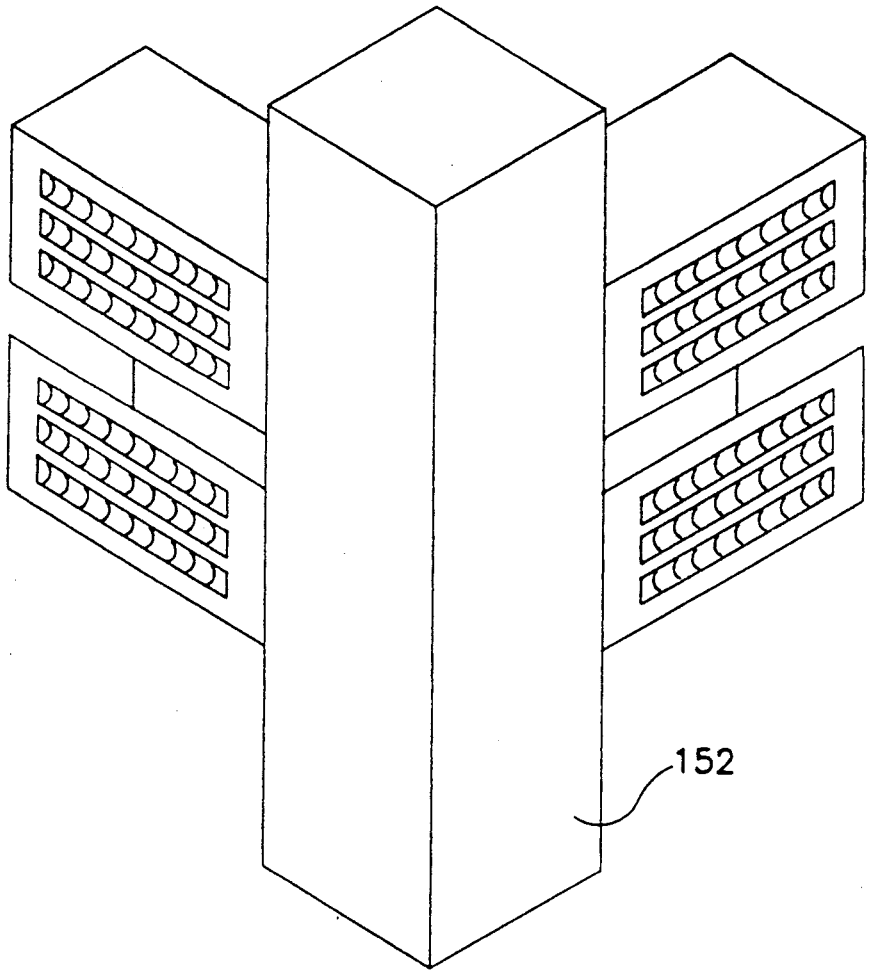
FIG. 44 is an isometric view of a connector piece for an outside corner.
Figure 45:
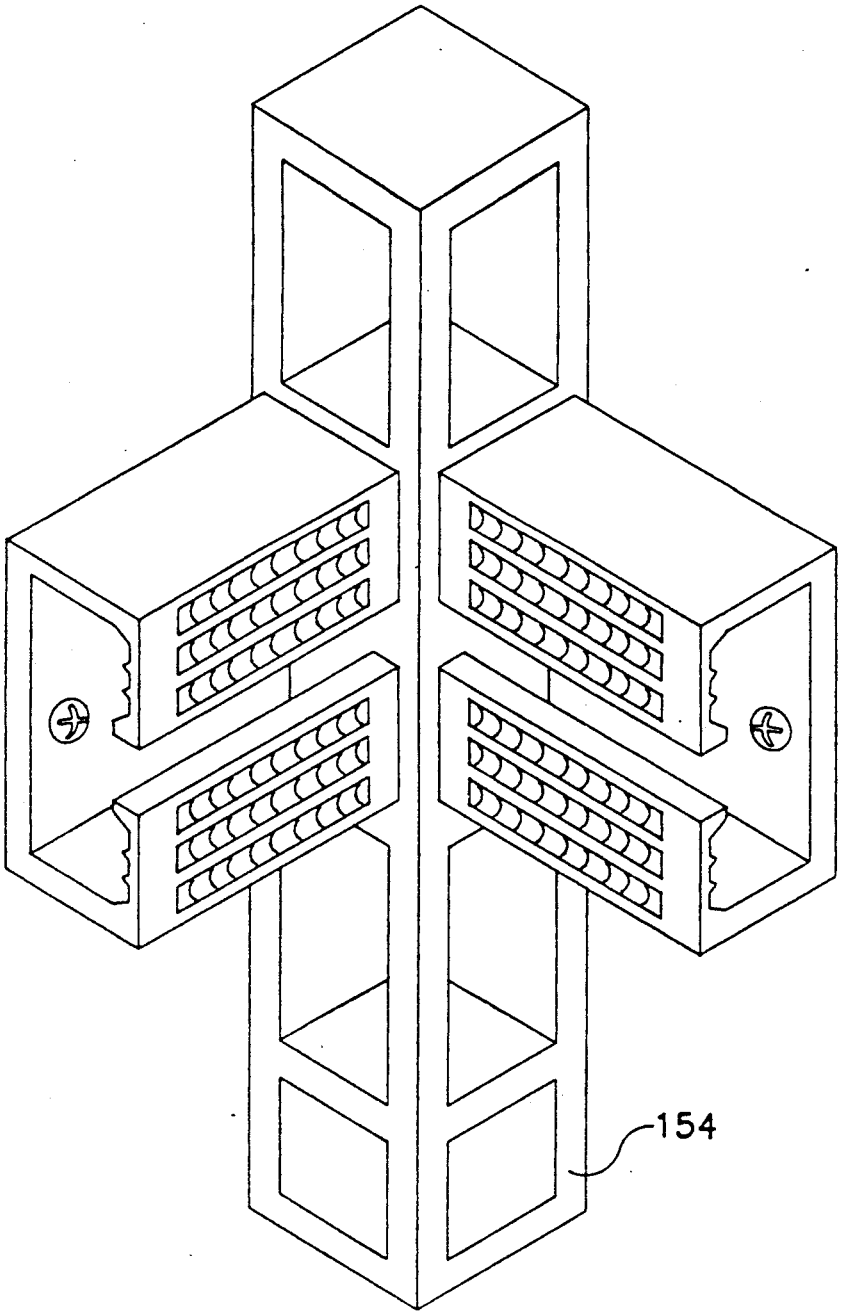
FIG. 45 is an isometric view of a connector piece for an inside corner.
Figure 46:
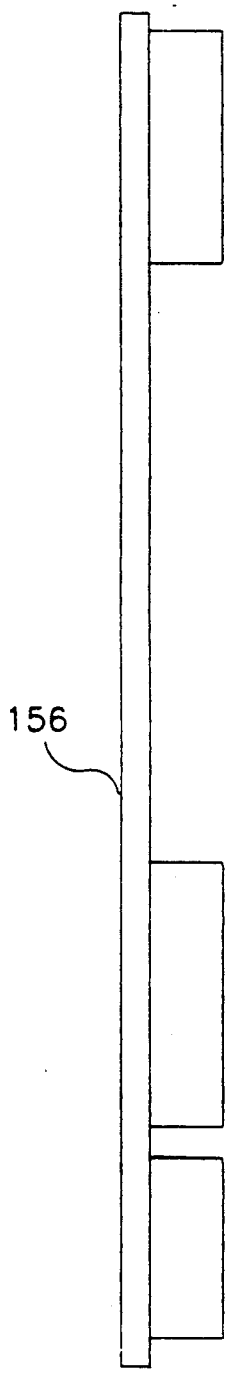
FIG. 46 is a side view of an end cap.
Figure 47:
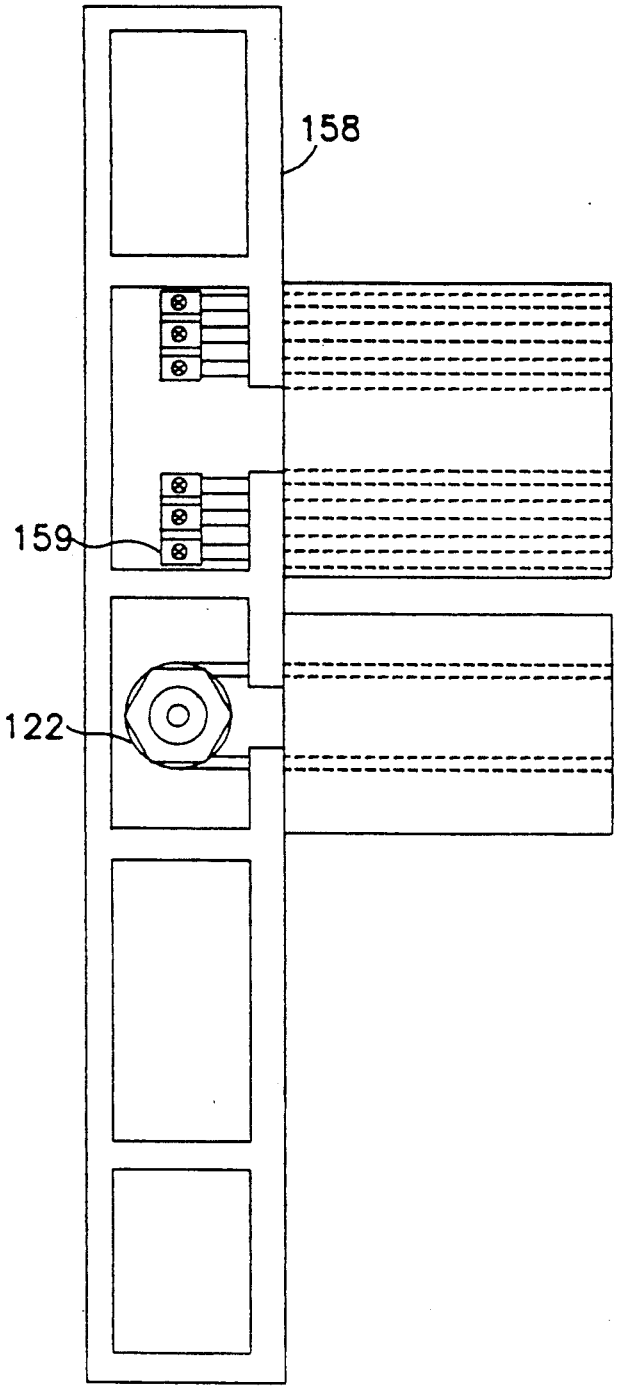
FIG. 47 is a rear view of the power connections.

FIGS. 43 through 47 illustrate connector pieces as in FIGS. 7 through 11 above, but accommodating six conductors per raceway. FIG. 43 illustrates a connector piece 150. FIG. 44 illustrates a connector piece 12 for an outside corner. FIG. 45 illustrates a connector piece 154 for an inside corner. FIG. 46 is a side view of an end cap 156 and FIG. 47 illustrates the power connection 158. In FIG. 47 the necessary coaxial balun is incorporated into the coaxial receptacle. Terminals 159 permit the attachment of a source of electrical power or telephone/audio signals etc.

FIGS. 51 and 52 illustrate how 12 conductors can be accommodated on one receptacle. FIG. 51 illustrates an expansion T-shaped connector 172 which is an expansion of connector 14. FIG. 52 illustrates the construction of the expansion raceway 172 having slot 174.

Figure 53:
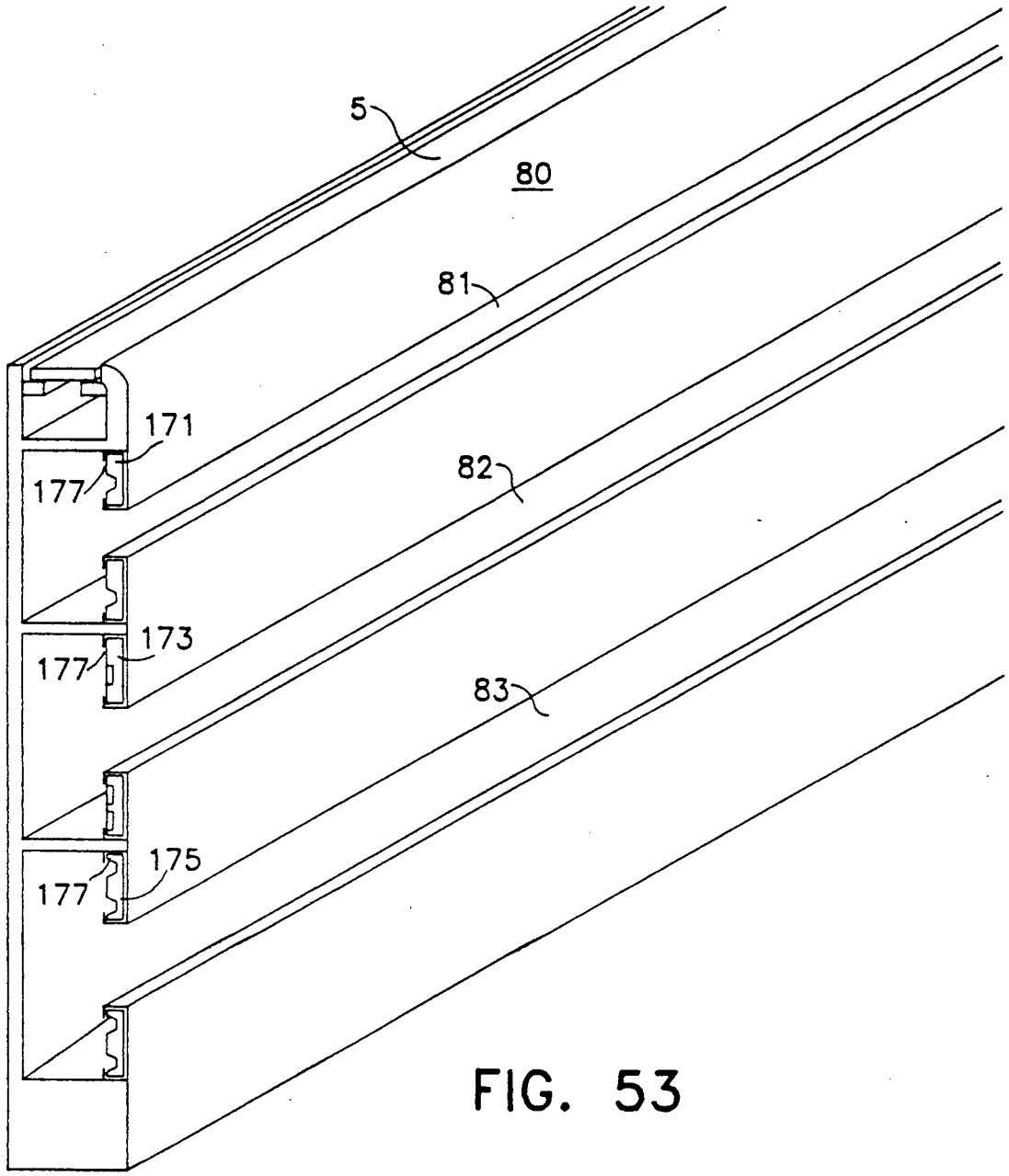
FIG. 53 is an isometric view of raceway utilizing conductive inserts.

FIG. 53 illustrates a raceway utilizing conductive inserts. Slots 177 in the baseboard 80 receive removable conductive inserts 171, 173, 175 which may have one or two conductive tracks. In this way the arrangement of receptacles can be varied. This also allows or the addition and updating in new technology.

As will be apparent to those skilled in the art, various modifications and adaptations of the structure above described may be made without departing from the spirit of the invention, the scope of which is to be construed in accordance with the accompanying claims. For example, while the invention has been described in the context of a unit resembling a baseboard, the same principles could be applied to a vertical track on a wall, a track mounted directly to the floor, or a ceiling-mounted track.

What is claimed is:

1. An electrical distribution system comprising:

a) an elongated housing having a front panel defining a hollow interior, and a plurality of parallel elongated slots formed in said front panel, said front panel having an inner and outer surface;

b) a plurality of pairs of electrical conduction means fixed to the inner surface of said front panel, each pair of said conduction means being parallel to and spaced from one of said slots;

c) means for providing an electrical differential between each said pair of conduction means; and d) a plurality of movable receptacle means for releasably engaging said housing, each receptacle means comprising a face having electrical receptacle means, means for releasably securing said movable receptacle to said housing and means for electrically engaging said conduction means, said conduction engaging means being adapted to engage said conduction means when one of said receptacle means is installed in one of said slots.

2. The electrical distribution system of claim 1 wherein one of said plurality of receptacles comprises a telephone receptacle.

3. The electrical distribution system of claim 1 wherein one of said plurality of receptacles comprises a standard electrical outlet.

4. The electrical distribution system of claim 1 wherein one of said plurality of receptacles comprises a coaxial cable receptacle.

5. The electrical distribution system of claim 3 wherein one of said plurality of receptacles comprises a telephone receptacle.

6. The electrical distribution system of claim 4 wherein one of said plurality of receptacles comprises a standard electrical outlet.

7. The electrical distribution system of claim 5 wherein one of said plurality of receptacles comprises a coaxial cable receptacle.

8. The electrical distribution system of claim 2 wherein one of said plurality of receptacles comprises a coaxial cable receptacle.

9. The electrical distribution system of claim 1 wherein said means for providing an electrical differential comprises a body having projection adapted to be mounted in an end of said hollow interior and provided with conductors located to contact said conduction means on said front panel, and terminal means connected to said conductors for providing an electrical differential between pairs of said conductors.

10. The electrical distribution system of claim 1 further comprising connector means having first and second ends, each end having a projection adapted to be fixedly mounted in an end of said hollow interior and provided with first and second conductors located to contact one of said pairs of electrical conduction means on said front panel, whereby an electrical connection is made between the conduction means of first and second housings when said first and second ends of said connector means are mounted in said first and second housings.

11. The electrical distribution system of claim 10 wherein said connector means comprises a central vertical post and said first and second ends meet said post at right angles.

* * * * *